US009758324B2

(12) United States Patent
Takase et al.

(10) Patent No.: US 9,758,324 B2
(45) Date of Patent: Sep. 12, 2017

(54) SHEET CONVEYANCE APPARATUS AND IMAGE FORMING APPARATUS

(71) Applicant: CANON KABUSHIKI KAISHA, Tokyo (JP)

(72) Inventors: Kazuki Takase, Mishima (JP); Motoyasu Muramatsu, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/955,415

(22) Filed: Dec. 1, 2015

(65) Prior Publication Data

US 2016/0159591 A1 Jun. 9, 2016

(30) Foreign Application Priority Data

Dec. 4, 2014 (JP) ..... 2014-246301
Dec. 4, 2014 (JP) ..... 2014-246302

(51) Int. Cl.
*B65H 3/52* (2006.01)
*B65H 3/34* (2006.01)
(Continued)

(52) U.S. Cl.
CPC ..... *B65H 3/34* (2013.01); *B65H 1/04* (2013.01); *B65H 3/0607* (2013.01); *B65H 3/5215* (2013.01); *B65H 3/56* (2013.01); *B65H 2402/31* (2013.01); *B65H 2402/543* (2013.01); *B65H 2405/324* (2013.01); *B65H 2407/21* (2013.01)

(58) Field of Classification Search
CPC ..... B65H 3/52; B65H 3/5207; B65H 3/5215; B65H 3/5246; B65H 3/5253; B65H 3/5261; B65H 3/56; B65H 3/66; B65H 2404/51; B65H 2404/511; B65H 2404/61; B65H 2404/722; B65H 2404/725; B65H 2404/741; B65H 2404/7412;
(Continued)

(56) References Cited

U.S. PATENT DOCUMENTS 4,852,868 A 8/1989 Fukui et al.
7,040,614 B2 * 5/2006 Sonoda ..... B65H 3/0661 271/117
(Continued)

FOREIGN PATENT DOCUMENTS

JP 63-225043 A 9/1988
JP 2003-118865 A 4/2003

*Primary Examiner* — Ernesto Suarez
(74) *Attorney, Agent, or Firm* — Fitzpatrick, Cella, Harper & Scinto

(57) ABSTRACT

A sheet conveyance apparatus is equipped with a stacking portion on which sheets are stacked, a rotator conveying a sheet by rotating in a contact state with the sheet stacked on the stacking portion, a separating member pressing the rotator and separating the sheets one by one at a contact portion where the rotator and the separating member contact each other, and a holder holding the separating member. A guide portion is rotatably provided with the holder and capable of guiding a front end of the sheet to the contact portion, and a regulating portion regulates the guide portion from rotating in a direction approximating the rotator in a state where the guide portion contacts against the regulating portion. The guide portion can be rotated in a direction separating from the rotator in a state where the separating member presses the rotator.

20 Claims, 19 Drawing Sheets

(51) Int. Cl.

| | |
|---|---|
| ***B65H 3/06*** | (2006.01) |
| ***B65H 1/04*** | (2006.01) |
| ***B65H 3/56*** | (2006.01) |

(58) Field of Classification Search
CPC ..... B65H 2404/7414; B65H 2404/743; B65H 2405/1134; B65H 2405/1136
See application file for complete search history.

(56) References Cited

U.S. PATENT DOCUMENTS

| | | | | |
|---|---|---|---|---|
| 7,731,177 | B2 * | 6/2010 | Ikeda | B65H 3/0661 271/121 |
| 7,980,551 | B2 * | 7/2011 | Kobayashi | B65H 3/0661 271/119 |
| 8,973,918 | B2 | 3/2015 | Muramatsu et al. | |
| 9,242,820 | B2 * | 1/2016 | Machii | B65H 3/5261 |
| 9,394,126 | B2 * | 7/2016 | Sakamoto | B65H 3/5261 |
| 2008/0309001 | A1 | 12/2008 | Muramatsu | |

* cited by examiner

SHEET CONVEYANCE APPARATUS AND IMAGE FORMING APPARATUS

BACKGROUND OF THE INVENTION

Field of the Invention

The present invention relates to a sheet conveyance apparatus for conveying sheets, and an image forming apparatus equipped with the same.

Description of the Related Art

Hitherto, image forming apparatuses, such as printers, are equipped with a sheet feeding apparatus, having sheets for recording images stacked on a tray and capable of separating and feeding the sheets one by one. Japanese Patent Application Laid-Open Publication No. 2003-118865 discloses a sheet feeding apparatus having a guide member for guiding sheets toward a separation nip for separating and feeding sheets one by one. The guide member is constituted movably when a bundle of sheets are fed.

Now, a conventional sheet feeding apparatus will be described with reference to FIGS. 18 and 19. A sheet feeding apparatus 301 is equipped with a pickup roller 310, a feed roller 353 and a retard roller 364, wherein a separation nip N is formed by having the retard roller 364 pressed against the feed roller 353 with a given pressure. A rotational driving force in a direction of arrow J1 is transmitted from a drive source not shown to the feed roller 353. A rotational driving force in a direction opposite to a sheet feeding direction (direction of arrow J3 of FIG. 19B) is transmitted via a torque limiter not shown to the retard roller 364.

Further, the sheet feeding apparatus 301 is equipped with a nip guide 363 preventing the sheet S from being caught between a sheet cassette 300 and the separation nip N and jammed. The nip guide 363 is supported rotatably on a rotating shaft 363*a*, and biased toward a direction approaching the feed roller 353 (direction of arrow J2) by a tension spring 366.

As shown in FIG. 18, a guide surface 363*b* of the nip guide 363 is positioned by a stopper 365 so as to form a given angle θ ($0<\theta<90$ degrees) with respect to a sheet feed direction H of the sheet S stacked on an intermediate plate 351 pushed up by a turning arm 356. When power is transmitted to the pickup roller 310, the feed roller 353 and the retard roller 364, and a single sheet S is fed by the pickup roller 310, the sheet S is guided by the nip guide 363 to a separation nip N, as shown in FIG. 19A. In other words, when a single sheet S is fed, hardly any load is applied from the sheet S to the guide surface 363*b* of the nip guide 363, so that the nip guide 363 remains abutted against the stopper 365 without rotating.

On the other hand, when multiple sheets S forming a bundle is sent out from the sheet cassette 300, a large amount of load is applied to the nip guide 363 from the bundle of sheets S. Thereby, as shown in FIG. 19B, the nip guide 363 rotates in a direction separating from the feed roller 353 (direction of arrow d). Even when only a single sheet S is fed by the pickup roller 310, if the sheet is a cardboard having a high stiffness, for example, a large load is applied on the nip guide 363, and the nip guide 363 rotates in a direction of arrow J4. When the nip guide 363 rotates in the direction of arrow J4, the given angle θ formed by the guide surface 363*b* and the bundle of sheets S is increased, so the sheets S are sorted while being guided to the separation nip N.

Meanwhile, Japanese Patent Application Laid-Open Publication No. S63-225043 teaches a sheet feeding apparatus equipped with a separating roller frame holding a separating roller (retard roller) in a swingable manner, and a feed-in guide plate supported rotatably on a separating roller frame and guiding the sheet to the separation nip. The feed-in guide plate is designed to rotate downward to prevent jamming of sheets when a large number of sheets are fed between the feed-in guide plate and a feed roller forming the separation nip together with the separating roller.

As described above, according to the sheet feeding apparatus disclosed in Japanese Patent Application Laid-Open Publication No. 2003-118865, the given angle θ between the nip guide 363 and the sheet S varies depending on the level of load applied to the nip guide 363 from the sheet S. For example, if a card board is fed from the sheet cassette 300, the nip guide 363 is pressed by the card board and rotates downward easily. Then, when the nip guide 363 is pressed by the sheet S and is migrated in a direction of arrow O, the abutting angle in which the front end of the sheet S abuts against the peripheral surface of the retard roller 364 is increased.

In order to correspond to the downsizing of recent printers, there is a tendency to minimize the outer diameter of the retard roller 364. In that case, the given angle θ between the nip guide 363 and the sheet S is changed, and the abutting angle between the front end of the sheet S and the peripheral surface of the retard roller 364 is increased significantly. Generally, the peripheral surface of the retard roller 364 is formed of a material having a high friction coefficient, so that if the front end of the sheet S collides against the retard roller 364 with a great abutting angle, the front end of the sheet S may be damaged greatly, or jamming of the sheet S may occur.

In the sheet feeding apparatus disclosed in Japanese Patent Application Laid-Open Publication No. S63-225043, the range of rotation of the feed-in guide plate is regulated by an upper limit stopper and a lower limit stopper disposed on a separating roller frame. The space between the upper limit stopper and the lower limit stopper is small, and the range of rotation of the feed-in guide plate is narrow. When the feed-in guide plate is pressed by a large number of sheets and rotates downward, the feed-in guide plate abuts against the upper limit stopper, but when the feed-in guide plate rotates further downward, the separating roller frame rotates downward together with the feed-in guide plate. Then, the separating roller held in the separating roller frame will be separated from the feed roller, and there is fear that the large number of sheets cannot be separated one by one and overlapped feeding may occur.

SUMMARY OF THE INVENTION

According to one aspect of this disclosure, a sheet conveyance apparatus includes a stacking portion on which sheets are stacked, a rotator conveying a sheet by rotating in a contact state with the sheet stacked on the stacking portion, a separating member pressing the rotator and separating the sheets one by one at a contact portion where the rotator and the separating member contact each other, a holder holding the separating member, a guide portion rotatably provided with the holder and capable of guiding a front end of the sheet to the contact portion, the guide portion configured to rotate in a direction separating from the rotator in a state where the separating member presses the rotator, and a regulating portion regulating the guide portion from rotating in a direction approaching the rotator in a state where the guide portion contacts against the regulating portion.

Further features of the present invention will become apparent from the following description of exemplary embodiments with reference to the attached drawings.

DESCRIPTION OF THE EMBODIMENTS

Embodiment 1

Figure 1:
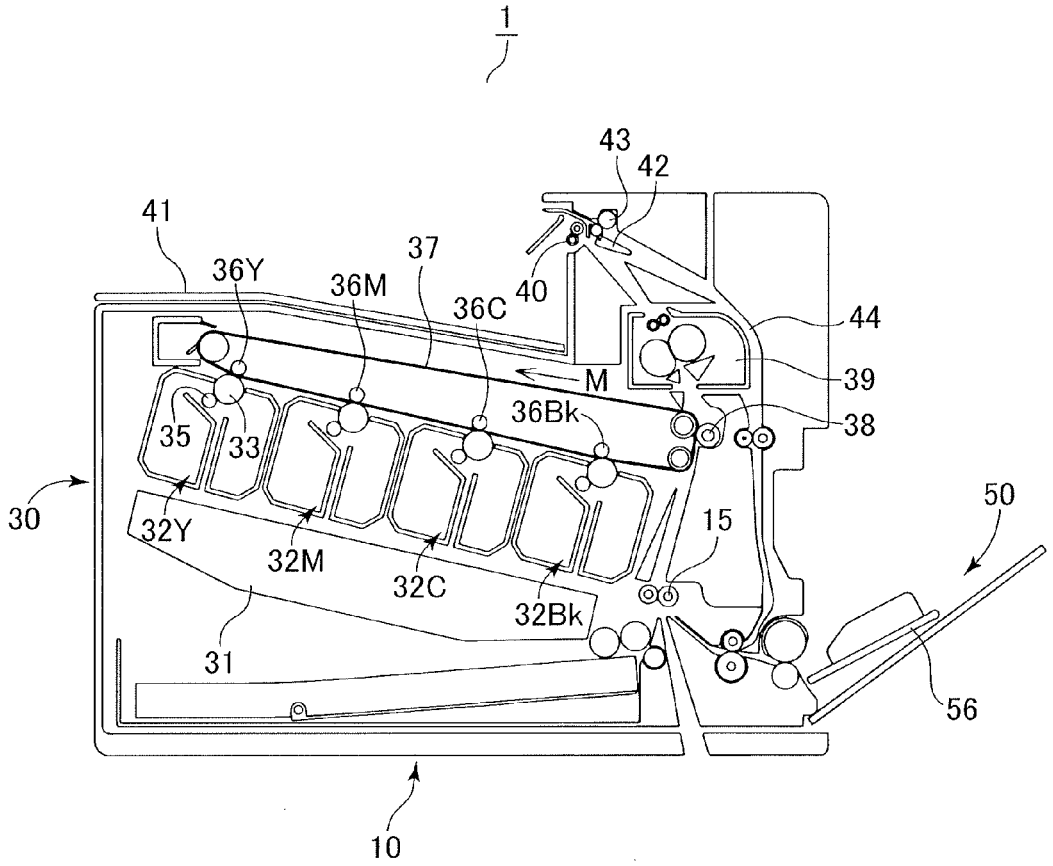
FIG. 1 is an overall schematic diagram showing a printer according to Embodiment 1 of the present invention.

Now, Embodiment 1 of the present invention will be described. A printer 1 (image forming apparatus) according to the preferred embodiment of the present invention is an electro-photographic laser beam printer forming four-color toner images. The printer 1 has, as shown in FIG. 1, a cassette sheet feed portion 10 and a manual sheet feed portion 50 for feeding sheets, and an image forming portion 30 for forming images to be transferred onto sheets.

When an image forming command is output to the printer 1, an image forming process by the image forming portion 30 is started based on image information entered from an external computer and the like connected to the printer 1. The image forming portion 30 is equipped with a scanner unit 31, and four process cartridges 32Y, 32M, 32C and 32Bk for forming four color images of yellow (Y), magenta (M), cyan (C) and black (Bk). The four process cartridges 32Y, 32M, 32C and 32Bk have the same configuration, except for the differences in the color of the formed images, so only the image forming process of process cartridge 32Y will be described, and descriptions of process cartridges 32M, 32C and 32Bk are omitted.

The scanner unit 31 irradiates laser beams to the photosensitive drum 33 of the process cartridge 32Y based on the entered image information. At this time, the photosensitive drum 33 is charged in advance by a charging roller, not shown, and by irradiating laser beams thereto, an electrostatic latent image is formed on the photosensitive drum 33. Thereafter, the electrostatic latent image is developed by a developing roller 35, and a yellow (Y) toner image is formed on the photosensitive drum 33.

Similarly, magenta (M), cyan (C) and black (Bk) toner images are also formed on the photosensitive drums of process cartridges 32M, 32C and 32Bk. The toner images of respective colors formed on the respective photosensitive drums are transferred via primary transfer rollers 36Y, 36M, 36C and 36Bk to an intermediate transfer belt 37, and conveyed via the intermediate transfer belt 37 rotating in direction M to a secondary transfer roller 38. The image forming processes of the respective colors are performed at matched timings so that the images are respectively overlapped on an upstream toner image primarily transferred to the intermediate transfer belt 37.

In parallel with the above-described image forming operation, the sheet stored in the cassette sheet feed portion 10 or the sheet stacked on the manual sheet feed portion 50 is fed one by one to a registration roller 15. Then, the toner image on the intermediate transfer belt 37 is transferred via the secondary transfer roller 38 onto the sheet conveyed by the registration roller 15 at a given conveyance timing. The toner image transferred onto the sheet is fixed at a fixing portion 39, and the sheet is then discharged via a discharge roller pair 40 onto a discharge tray 41.

When forming images on both sides of a sheet, the sheet having an image formed on a first side thereof by the secondary transfer roller 38 is guided toward an inverting roller pair 43 via a switching member 42, turned over by the inverting roller pair 43, and guided to a duplex conveyance path 44. Then, the sheet is conveyed again to the registration roller 15, where an image is formed on a second side thereof by the secondary transfer roller 38, and the sheet is discharged onto the discharge tray 41.

Figure 3:
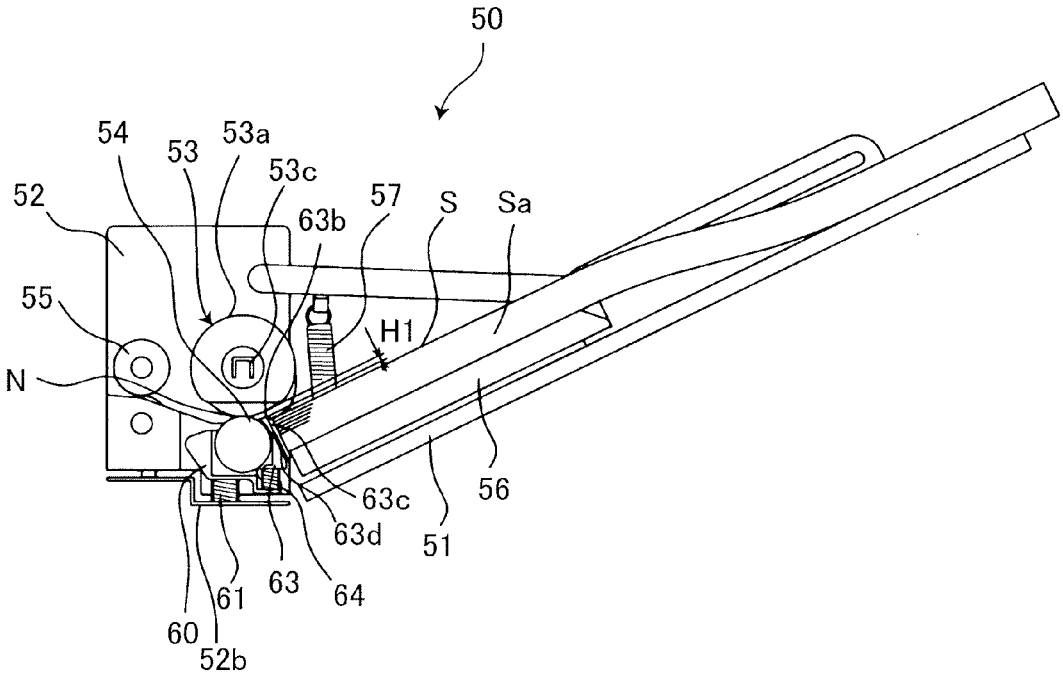
FIG. 3 is an overall cross-sectional view showing the manual sheet feed portion.
Figure 4:
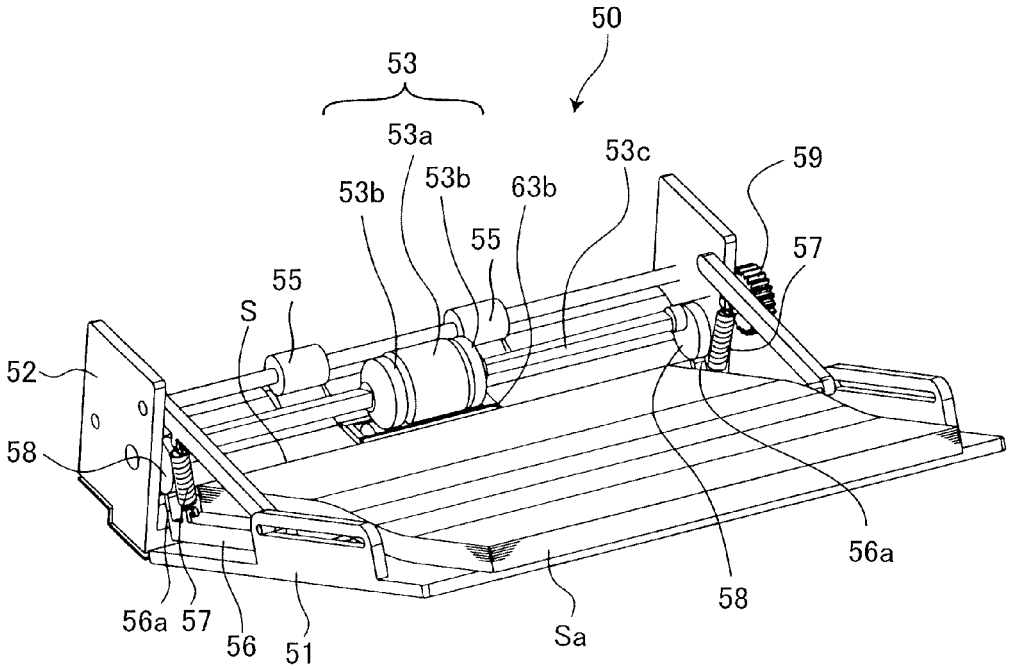
FIG. 4 is an overall perspective view showing the manual sheet feed portion.

Next, the manual sheet feed portion 50 as a sheet conveyance apparatus will be described with reference to FIGS. 2, 3 and 4. The manual sheet feed portion 50 is equipped with a sheet tray 51 capable of having a sheet S or a sheet bundle Sa stacked thereon, and a feed roller 53 (rotator) and a conveyance roller pair 55 supported rotatably on a sheet feed frame 52 (frame member) as a fixing member. Further, the manual sheet feed portion 50 has a separating roller 54 (separating member) including a torque limiter not shown built therein. An intermediate plate 56 (stacking portion) is supported rotatably on the sheet tray 51 so that a downstream side of the plate in a sheet feed direction can be lifted. The intermediate plate 56 is biased via an intermediate plate spring 57 toward the feed roller 53, so that the plate 56 contacts the feed roller 53 to enable an uppermost sheet S on the sheet bundle Sa to be fed.

Further, the intermediate plate 56 must be separated from the feed roller 53 by a distance equal to or greater than a maximum sheet stacking height each time the sheet feed operation is completed, to enable sheets to be stacked additionally whenever a stacked sheet is fed. Therefore, as shown in FIG. 4, elevating cams 58 and 58 are fixed to the feed roller shaft 53*c* supporting the feed roller 53 in a rotatable manner, and slidable cam followers 56*a* and 56*a* with respect to the elevating cams 58 and 58 are formed on the intermediate plate 56. A feed roller gear 59 is mounted to a shaft end portion of the feed roller shaft 53*c*, and a clutch not shown is attached at an upstream side in a drive transmission path of the feed roller gear 59. Through this clutch, the power transmitted to the feed roller 53 from a drive source not shown can be connected and disconnected.

During the state where the feed roller 53 is in a standby state, the cam followers 56*a* and 56*a* of the intermediate plate 56 are pushed down by the elevating cams 58 and 58, and sheets can be stacked on the intermediate plate 56. When the clutch is in an engaged state and the feed roller shaft 53*c* is rotated, the cam followers 56*a* and 56*a* slide along the elevating cams 58 and 58 and the intermediate plate 56 is elevated by the intermediate plate spring 57. Then, the uppermost sheet S of the sheet bundle Sa stacked on the intermediate plate 56 abuts against the feed roller 53, and the sheet S is fed via the feed roller 53. When the feed roller 53 rotates once, the sheet S is conveyed via the conveyance roller pair 55 and 55 arranged downstream in the sheet feed direction, and the intermediate plate 56 will be pushed down again by the elevating cams 58 and 58.

When the feed roller 53 rotates once to have the sheet S conveyed by the conveyance roller pair 55 and 55, the sheet S conveyed by the conveyance roller pair 55 and 55 slides against the stopped feed roller 53, causing uneven wear of a feed roller rubber 53*a* covering an outer peripheral surface of the feed roller 53. Therefore, the feed roller 53 is equipped with the feed roller rubber 53*a* formed in a D-cut shape, and driven feed rollers 53*b* and 53*b* supported in a rotatable manner on both ends in an axial direction of the feed roller rubber 53*a*. The driven feed rollers 53*b* and 53*b* are formed to have a smaller outer diameter than the feed roller rubber 53*a*, and the driven feed rollers protrude in an outer diameter direction from the roller covered by the feed roller rubber 53*a* only at areas where the feed roller rubber 53*a* are subjected to D-cut.

During the standby state, the feed roller 53 stands by at a position where the driven feed rollers 53*b* and 53*b* contact the sheet S, and when the sheet S is conveyed by the conveyance roller pair 55 and 55, the sheet S does not slide against the feed roller rubber 53*a*. Thus, uneven wear of the feed roller rubber 53*a* can be prevented, and the life of the feed roller 53 can be elongated.

Figure 2:
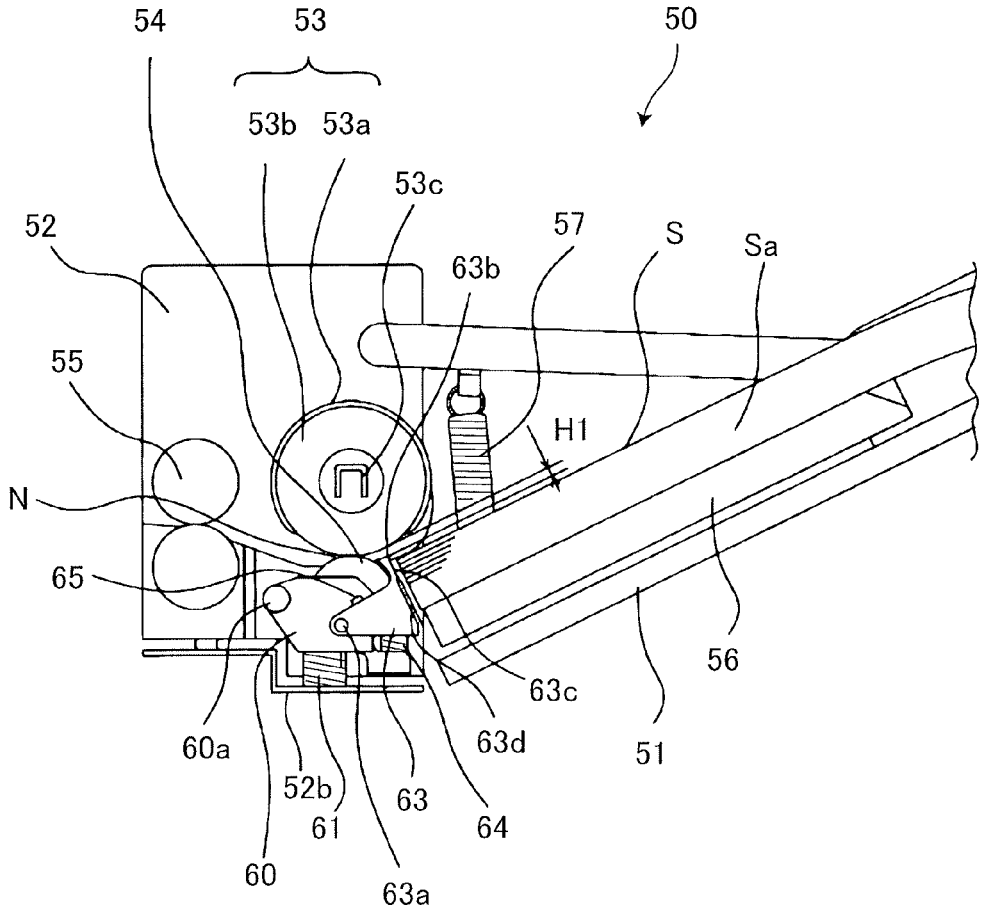
FIG. 2 is an overall front view showing a manual sheet feed portion.

As shown in FIG. 2, a separating roller holder 60 is supported rotatably around a rotation fulcrum 60*a* on the sheet feed frame 52, and the separating roller holder 60 holds the separating roller 54 in a rotatable manner. The separating roller holder 60 is biased upward via a separation spring 61 (first biasing member), by which the separating roller 54 contacts the feed roller 53 with a given contact pressure, forming a separation nip N (contact portion). The separation spring 61 is disposed in a compressed manner between the separating roller holder 60 and a bottom panel 52*b* of the sheet feed frame 52. The sheet S fed by the feed roller 53 is separated one by one by the separation nip N and conveyed to the conveyance roller pair 55.

A nip guide 63 (guide member) is disposed between the separation nip N and the sheet bundle Sa stacked on the intermediate plate 56, and the nip guide 63 is supported rotatably to the separating roller holder 60 around a rotation fulcrum 63*a*. A front end guide 63*b* (pressure surface) for guiding the sheet S smoothly to the separation nip N is formed on the upper surface of the nip guide 63, and a guide surface 63*c* (abutting surface) is formed on the right side surface of the nip guide 63 to which the front end of the sheet S contacts.

The nip guide 63 is biased upward by a nip guide spring (second biasing member), and positioned at an abutting position where the nip guide abuts against a stopper 65 (regulating portion) provided to the separating roller holder 60. The nip guide spring 64 is disposed in a compressed manner between the nip guide 63 and the separating roller holder 60. In the state where the nip guide 63 is at an abutting position, the front end guide 63*b* and an outer peripheral surface of the feed roller 53 are separated by a given distance H1. On the right side of the nip guide 63 is formed the above-mentioned guide surface 63*c*, and a sheet non-contact surface 63*d* formed below the guide surface 63*c* (refer to FIG. 5). The sheet feed frame 52 has an abutment surface 52*a* bent to cover the sheet non-contact surface 63*d*, so as to prevent sheets from abutting against the sheet non-contact surface 63*d*.

In other words, the sheet non-contact surface 63*d* is formed so that the nip guide 63 shown in FIG. 2 rotates in a clockwise direction by having the sheet stacked on the intermediate plate 56 contact the sheet non-contact surface 63*d*. When the nip guide 63 rotates in the clockwise direction, a sheet bundle thicker than the given distance H1 may easily enter the separation nip N.

Therefore, according to the present embodiment, the abutment surface 52*a* is formed on the sheet feed frame 52 so as to prevent sheets from abutting against the sheet non-contact surface 63*d* and to make it difficult for the sheet bundle thicker than the given distance H1 to enter the separation nip N. Thus, it becomes possible to prevent the ends of sheets from being damaged and improve the separation performance of the sheets. Further, the abutment surface 52*a* is formed to abut against the sheet bundle Sa stacked on the intermediate plate 56 approximately perpendicularly, and prevent the sheet bundle Sa from being damaged when the intermediate plate 56 is lifted or lowered. When a sheet abuts against the guide surface 63*c* of the nip guide 63, force acts on the nip guide 63 so that the nip guide 63 in FIG. 2 rotates in a counterclockwise direction.

Next, a series of actions of the manual sheet feed portion 50 will be described with reference to FIGS. 5 through 13. When the sheet bundle Sa is stacked on the sheet tray 51 and a sheet feed signal is sent from the printer 1, a driving source not shown is driven, and a clutch not shown is turned on according to a given sheet feed timing. Thereby, the intermediate plate 56 is lifted, the sheet bundle Sa is abutted against the feed roller 53, the feed roller 53 is rotated in the clockwise direction of FIG. 5, and the uppermost sheet S of the sheet bundle Sa is started to be conveyed to the separation nip N.

Figure 5:
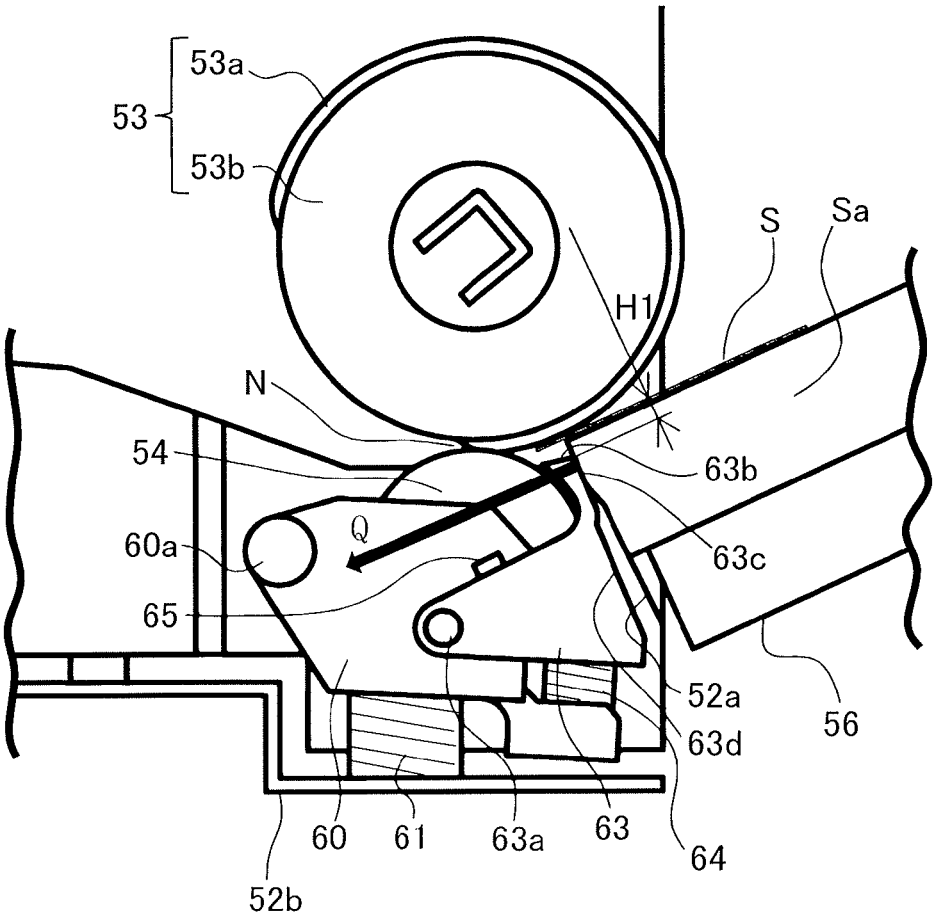
FIG. 5 is a front view showing the manual sheet feed portion in a state where a single sheet is fed.
Figure 6:
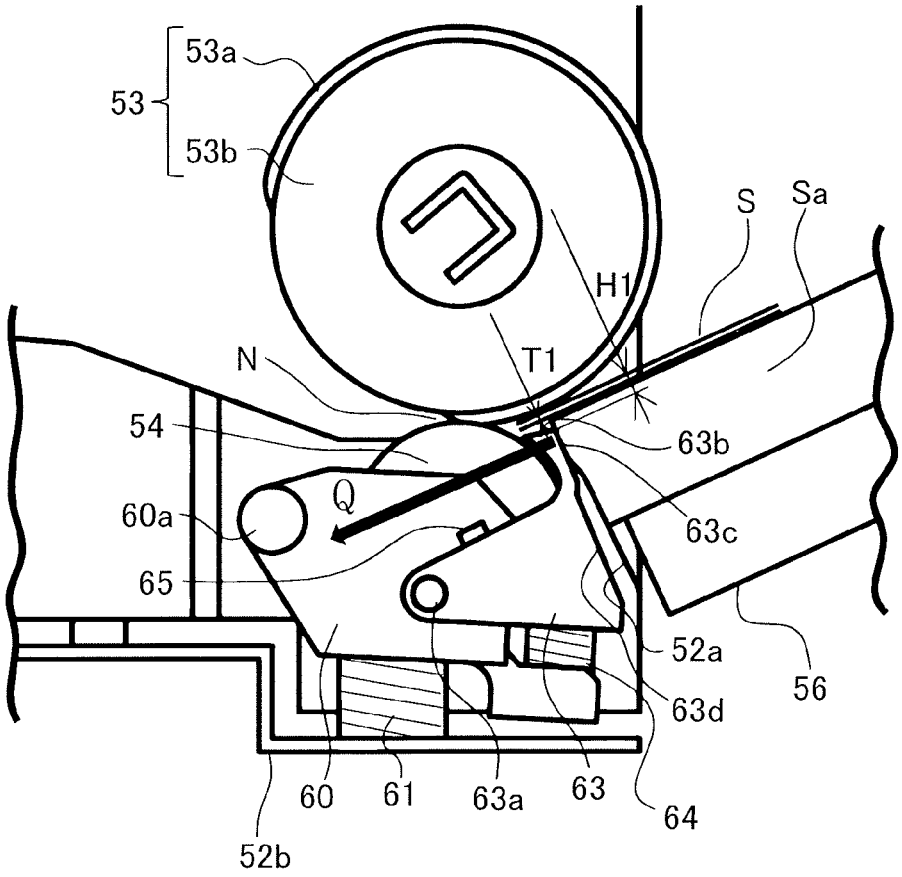
FIG. 6 is a front view showing a manual sheet feed portion in a state where multiple sheets are fed.
Figure 7:
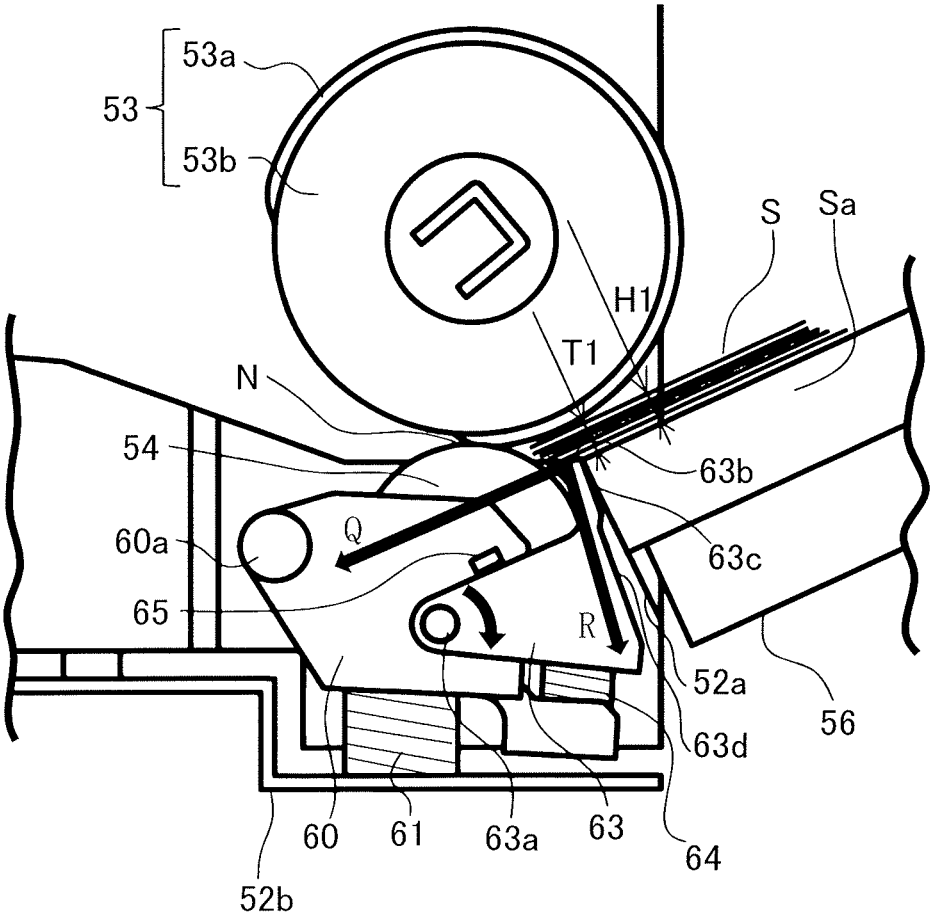
FIG. 7 is a front view showing a manual sheet feed portion in a state where a nip guide is rotated by a large number of sheets.

Now, we will describe two cases, a case where a single sheet S of the sheet bundle Sa is fed by the feed roller 53, and a case where multiple sheets S are fed, with reference to FIGS. 5 through 7. At first, when the sheet S is fed one by one, as shown in FIG. 5, the sheet S is passed between the feed roller 53 and the front end guide 63*b*, and conveyed toward the separation nip N. As for the sheet bundle Sa excluding the uppermost sheet S, when the uppermost sheet S receives a conveying force toward the separation nip N by the feed roller 53, the sheet bundle contacts the guide surface 63*c* by the friction among sheets, and pressing force is generated thereby.

Therefore, the nip guide 63 receives a pressing force in a direction of arrow Q in the guide surface 63*c*, and attempts to rotate in a counterclockwise direction around the rotation fulcrum 63*a* as fulcrum, but the stopper 65 restricts the rotation in the counterclockwise direction (direction approximating the feed roller 53). Thus, the nip guide 63 is held at the abutting position abutted against the stopper 65.

Therefore, even when various types of sheets having different stiffness, such as thin paper and thick paper, are fed, the position of the nip guide 63 will not vary, and the front end guide 63*b* of the nip guide 63 will not move away from the feed roller 53, increasing the contact angle between the front end of the sheet S and the separating roller 54. Thus, the front end of the sheet S will not collide against the separating roller 54 by the enlarged contact angle between the front end of the sheet S and the separating roller 54, and the damaging of the front end of the sheet S can be reduced. Furthermore, it becomes possible to prevent the sheet S from running into the separating roller 54 and causing jamming.

Now, when a single sheet S is fed to the separation nip N, the friction force between the feed roller 53 and the separating roller 54 causes a torque limiter not shown built into the separating roller 54 to rotate idly. Thereby, the separating roller 54 is driven to rotate by the sheet S conveyed to a sheet feed direction, and the sheet S is conveyed to the downstream side.

Next, we will describe examples where multiple sheets S are fed in a bundle by the feed roller 53. There are two such cases, which are described below.

A first case is an example where a few sheets from the upper portion of the sheet bundle Sa surpass the guide surface 63*c* and are conveyed to the separation nip N, as shown in FIG. 6. In other words, the first case is when a thickness T1 of the number of sheets S having surpassed the guide surface 63*c* is smaller than the given distance H1 between the front end guide 63*b* and the outer peripheral surface of the feed roller 53 (T1<H1).

In that case, similar to the case where a single sheet S is fed to the separation nip N, the nip guide 63 receives a pressing force in the direction of arrow Q (sheet conveyance direction) in the guide surface 63*c* and attempts to rotate in the counterclockwise direction, though the rotating motion is restricted by the stopper 65. The number of sheets S having surpassed the guide surface 63*c* passes between the feed roller 53 and the front end guide 63*b*, and is conveyed to the separation nip N. At this time, since the friction force between the sheets S is small compared to the load of a torque limiter not shown, the separating roller 54 will not rotate, and the number of sheets S can be separated into single sheets at the separation nip N. Thereby, among the number of sheets fed from the intermediate plate 56, only the uppermost sheet S is conveyed downstream in the conveyance direction, and the other sheets are stopped by the ceased separating roller 54 and stay at the separation nip N.

A second case is an example where the thickness T1 of the number of sheets S having surpassed the guide surface 63*c* is equal to or greater than the given distance H1 (T1≥H1), as shown in FIG. 7. In that case, the bundle of sheets S is sandwiched between the front end guide 63*b* and the feed roller 53. Then, a reaction force of the nipping force sandwiching the bundle of sheets S at the front end guide 63*b* acts on the nip guide 63 in a direction of arrow R. Thereby, the nip guide 63 rotates by the force in the direction of arrow R in the clockwise direction around the rotation fulcrum 63*a*, that is, in the direction moving away from the feed roller 53, opposing to the biasing force of the nip guide spring 64.

When the nip guide 63 rotates in the clockwise direction, the nipping force of the nip guide 63 and the feed roller 53 applied on the bundle of sheets S will only be the force generated by the biasing force of the nip guide spring 64. As a result, the nipping force of the bundle of sheets S is reduced. When the bundle of sheets S reaches the separation nip N in this state, the separating roller 54 will not rotate since the friction force among the sheets S is small compared to the load of the torque limiter not shown, and therefore, the bundle of sheets S can be sorted. Then, only the uppermost sheet out of the bundle of sheets S is conveyed downstream in the sheet conveyance direction.

Figure 8:
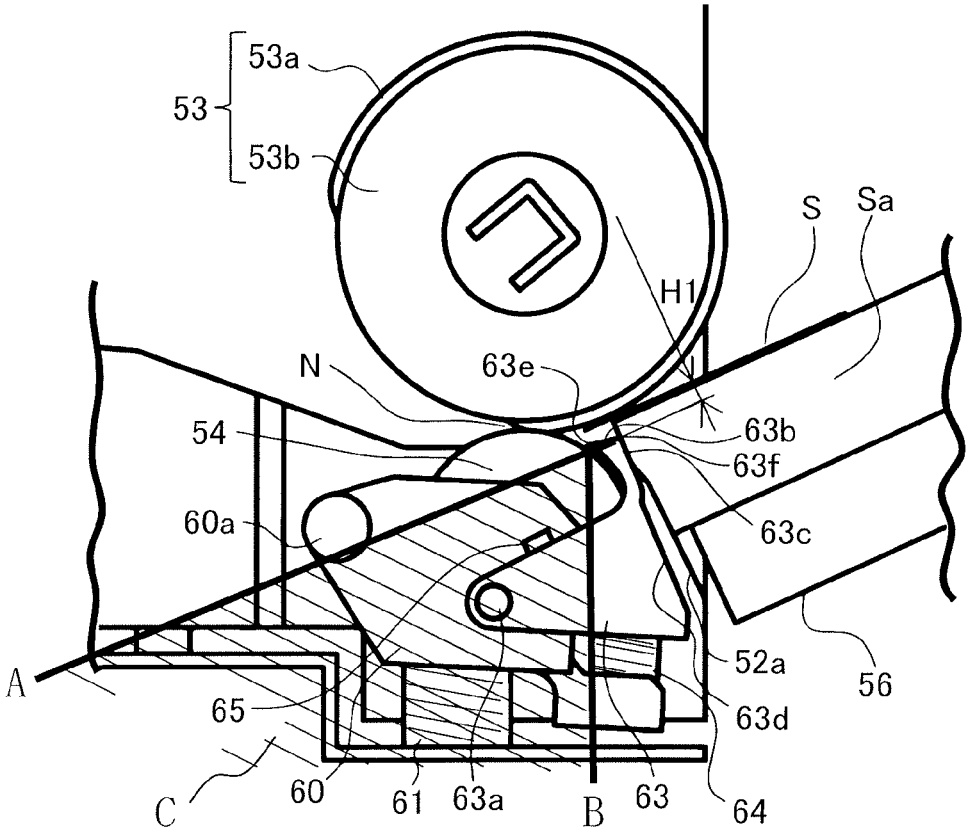
FIG. 8 is an explanatory view for explaining a position of a rotation fulcrum of the nip guide.

The position of the rotation fulcrum 63*a* of the nip guide 63 is determined to be at the position illustrated in FIG. 8, so that the nip guide 63 rotates in the clockwise direction when the bundle of sheets S is sandwiched between the front end guide 63*b* and the feed roller 53. In other words, the rotation fulcrum 63*a* is positioned on a side far from the feed roller 53 with respect to a first straight line A passing an end portion 63*f* of the side closest to the feed roller 53 of the guide surface 63*c* and perpendicular to the guide surface 63*c*. Further, the rotation fulcrum 63*a* is positioned on a side near the separation nip N with respect to a second straight line B passing a lower end 63*e* in the sheet conveyance direction of the front end guide 63*b* and parallel to a normal line of the separation nip N. As described, the area on the side far from the feed roller 53 with respect to the first straight line A and on the side close to the separation nip N with respect to the second straight line B (shaded area in the drawing) is referred to as area C.

Figure 9A:
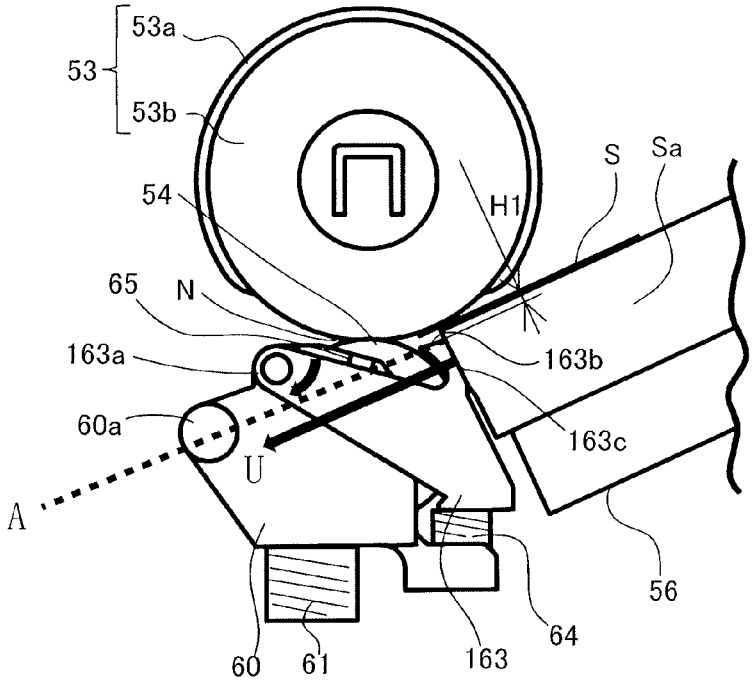
FIG. 9A is a view illustrating a manual sheet feed portion as a comparative example, where the rotation fulcrum of the nip guide is arranged at a side close to a feed roller with respect to a first straight line.
Figure 9B:
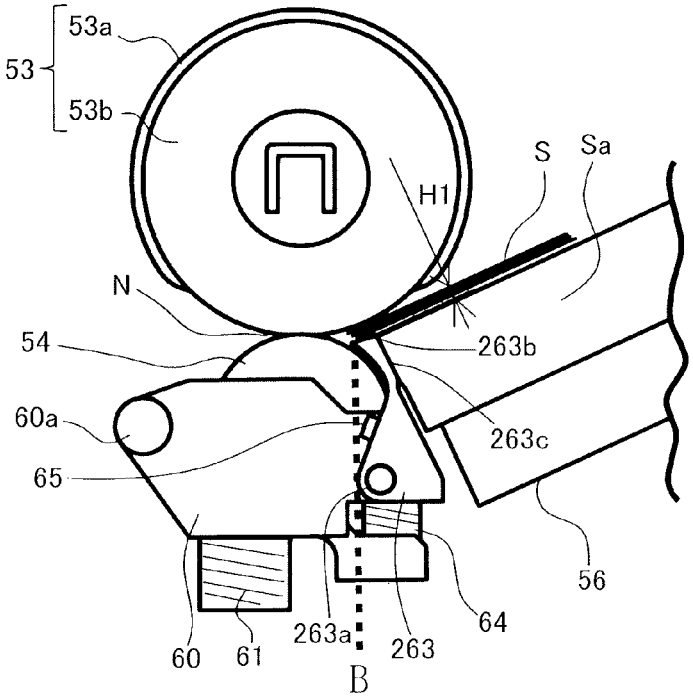
FIG. 9B is a view illustrating a manual sheet feed portion as a comparative example, where the rotation fulcrum of the nip guide is arranged at a far side from the separation nip with respect to a second straight line.

We will now describe, as a comparative example, a configuration where the rotation fulcrum 63*a* of the nip guide 63 is not arranged in area C, with reference to FIGS. 9A and 9B. In the comparative example, the configurations that are the same as the present embodiment are assigned with the same reference numbers in the drawings, and descriptions thereof are omitted. At first, we will describe an example where a rotation fulcrum 163*a* of a nip guide 163 is arranged on the side of the feed roller 53 with respect to the first straight line A, as shown in FIG. 9A.

In such case, the nip guide 163 rotates in the clockwise direction by the pressing force in a direction of arrow U of the sheet bundle Sa in contact with a guide surface 163*c*. Then, the given distance H1 between a front end guide 163*b* and the feed roller 53 is widened, and an abutting angle between the front end of the sheets S surpassing the guide surface 163*c* and abutted against the separating roller 54 and the peripheral surface of the separating roller 54 is increased significantly. Since the friction coefficient of the peripheral surface of the separating roller 54 is set high, when the front end of the sheet S collides against the separating roller 54 with a high abutting angle, serious damage may be caused to the front end of the sheet, or jamming of the sheet may occur.

Next, as shown in FIG. 9B, we will describe a case where a rotation fulcrum 263*a* of a nip guide 263 is arranged on the side of the separation nip N with respect to the second straight line B. In such case, when a bundle of sheets S having a thickness equal to or greater than the given distance H1 is sandwiched between a front end guide 263*b* of the nip guide 263 and the feed roller 53, the nip guide 263 attempts to rotate in the counterclockwise direction. Then, a nipping pressure of the bundle of sheets S is increased, and a conveying force is generated between a front end guide 263*b* and the feed roller 53. When this conveying force becomes excessive, multiple sheets S may surpass the separation nip N and be conveyed, so that overlapped feeding of the sheets occurs and jamming is caused.

Therefore, according to the present embodiment, the rotation fulcrum 63*a* of the nip guide 63 is arranged in area C, so that pressing force from the sheet bundle Sa acts on the guide surface 63*c* of the nip guide 63, and the nip guide 63 attempts to rotate in the counterclockwise direction. However, since the nip guide 63 is positioned at an abutting position by the stopper 65, the front end of the sheet will not collide against the separating member in a state where the abutting angle between the front end of the conveyed sheet S and the peripheral surface of the separating roller 54 is great. Thus, damage to the front end of the sheet can be reduced, and the occurrence of jamming of the sheet by the sheet wedging into the separating member can be prevented.

Further, when the bundle of sheets S having a thickness equal to or greater than the given distance H1 is sandwiched between the front end guide 63*b* of the nip guide 63 and the feed roller 53, the nip guide 63 rotates in the clockwise direction, opposing to the biasing force of the nip guide spring 64. At this time, the biasing force of the separation spring 61 disposed in a compressed manner between the separating roller holder 60 and the bottom panel 52*b* of the sheet feed frame 52 (refer to FIG. 2) is set sufficiently higher than the biasing force of the nip guide spring 64 disposed in a compressed manner between the separating roller holder 60 and the nip guide 63.

Therefore, even when the nip guide 63 rotates in the clockwise direction, the separating roller holder 60 will not rotate together with the nip guide 63. Thus, a state is maintained where the separating roller 54 presses the feed roller 53, so that the sheets can be separated one by one without fail. Further, it is possible to prevent the bundle of sheets S from being clogged between the front end guide 63*b* of the nip guide 63 and the feed roller 53 and causing jamming.

According further to the present embodiment, the rotation fulcrum 63*a* of the nip guide 63 and the stopper 65 are provided on the separating roller holder 60. This is because the feed roller 53 is composed of the feed roller rubber 53*a* and the driven feed rollers 53*b* having different outer diameters, and the diameters of the areas in contact with the separating roller 54 vary while the feed roller 53 rotates once.

Now, as a comparative example, we will describe an example where a rotation fulcrum of a nip guide and a stopper are disposed on the sheet feed frame 52 as rotation fulcrum 463*a* and stopper 465, with reference to FIGS. 10A through 10D. In the present comparative example, the components that are the same as the present embodiment are denoted with the same reference numbers in the drawings, and descriptions thereof are omitted.

Figure 10A:
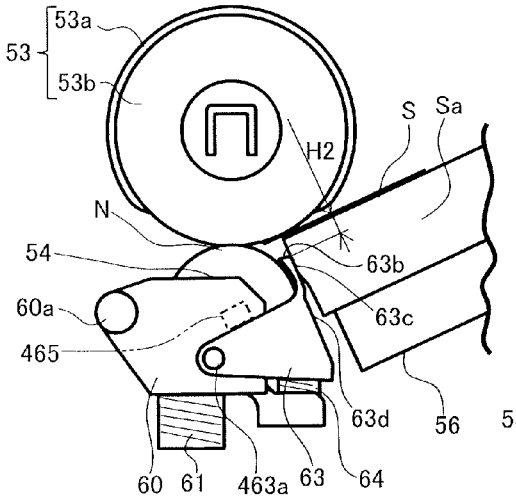
FIG. 10A is a front view of a comparative example where a stopper and the rotation fulcrum of the nip guide are arranged on a sheet feed frame, showing a manual sheet feed portion in a state where a driven feed roller is abutted against a separating roller.
Figure 10B:
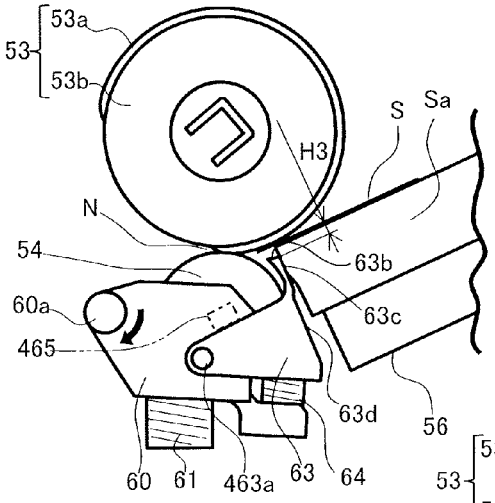
FIG. 10B is a front view of a comparative example where the stopper and the rotation fulcrum of the nip guide are arranged on a sheet feed frame, showing a manual sheet feed portion in a state where a feed roller rubber is abutted against the separating roller.

When the driven feed rollers 53*b* and the front end guide 63*b* oppose each other, as shown in FIG. 10A, the feed roller 53 and the front end guide 63*b* are separated by a given distance H2. When the feed roller rubber 53*a* and the front end guide 63*b* oppose each other, as shown in FIG. 10B, the feed roller 53 and the front end guide 63*b* are separated by a given distance H3. Therefore, when the feed roller 53 rotates once to feed the sheet S stacked on the intermediate plate 56, the distance between the feed roller 53 and the front end guide 63*b* which is set to given distance H2 during standby changes to a given distance H3 during feeding.

Further, when the feed roller rotates once, the diameter of the feed roller 53 is varied at the separation nip N, so that the separating roller 54 and the separating roller holder 60 rotates in accordance with the diameter of the feed roller 53. This rotation of the separating roller 54 and the separating roller holder 60 is performed before the sheet S reaches the separation nip N. However, according to this comparative example, since the rotation fulcrum 463*a* and the stopper 465 are disposed on the sheet feed frame 52, the nip guide 63 will not follow the separating roller holder 60 even when the separating roller holder 60 rotates.

Figure 10C:
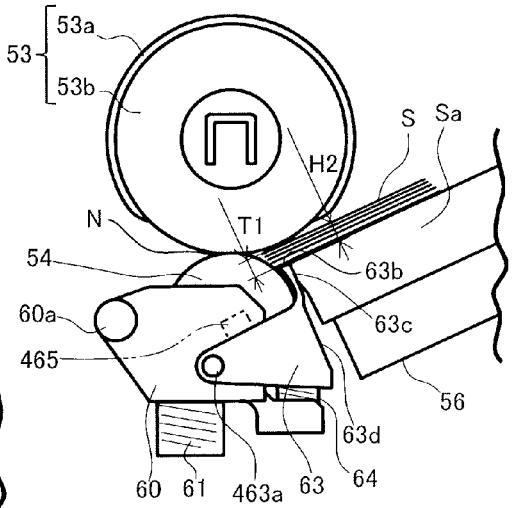
FIG. 10C is a front view of a comparative example where the stopper and the rotation fulcrum of the nip guide are arranged on a sheet feed frame, showing a manual sheet feed portion in a state where multiple sheets being fed are abutted against the driven feed roller.
Figure 10D:
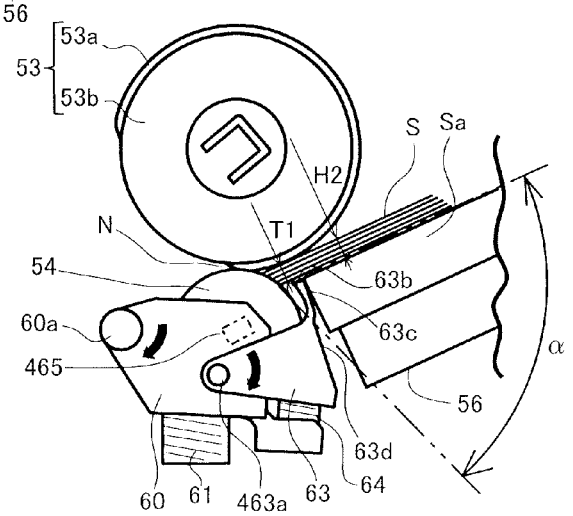
FIG. 10D is a front view of a comparative example where the stopper and the rotation fulcrum of the nip guide are arranged on a sheet feed frame, showing a manual sheet feed portion in a state where multiple sheets being fed are abutted against the feed roller rubber.

As shown in FIGS. 10C and 10D, when the thickness T1 of the sheet S having surpassed the guide surface 63*c* is equal to the given distance H2 (T1=H2), when the feed roller 53 rotates once, the nip guide 63 rotates in correspondence to the amount of change from the given distance H2 to the given distance H3. Thereby, an abutting angle $\alpha$ between the front end of the sheet S and the peripheral surface of the separating roller 54 is increased significantly. Since the friction coefficient of the peripheral surface of the separating roller 54 is set high, when the front end of the sheet S collides against the separating roller 54 with a high abutting angle $\alpha$, serious damage may be caused to the front end of the sheet, or jamming of the sheet may occur.

Figure 11A:
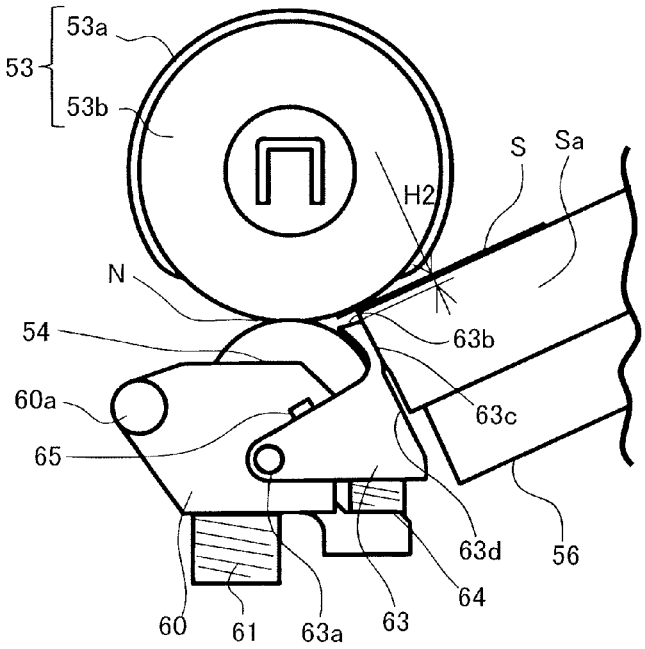
FIG. 11A is a front view of a manual sheet feed portion according to Embodiment 1, showing a state where the driven feed roller is abutted against the separating roller.
Figure 11B:
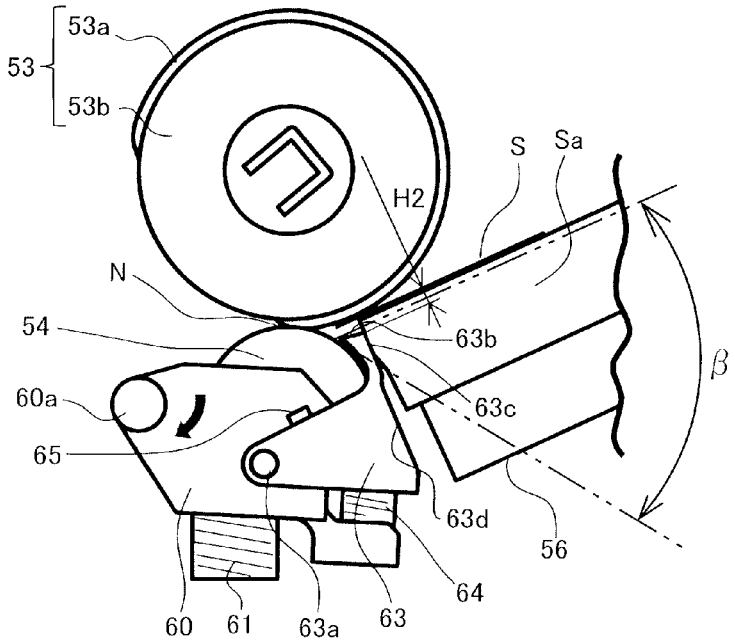
FIG. 11B is a front view illustrating an abutting angle between the front end of the sheet and the separating roller.

Therefore, the present embodiment adopts a configuration as shown in FIG. 11 where the rotation fulcrum 63*a* of the nip guide 63 and the stopper 65 are disposed on the separating roller holder 60, and when the separating roller holder 60 rotates, the nip guide 63 is set to follow the rotation of the separating roller holder 60. In other words, in the separation nip N, even if the diameter of the feed roller 53 is varied and the separating roller 54 and the separating roller holder 60 are rotated, the distance between the feed roller 53 and the front end guide 63*b* will always be the given distance H2. This is because the separating roller 54 and the separating roller holder 60 are pushed down by the feed roller rubber 53*a* before the nip guide 63 is rotated by the bundle of sheets S sandwiched between the feed roller rubber 53*a* and the front end guide 63*b*. Thereby, an abutting angle β between the front end of the sheet S and the peripheral surface of the separating roller 54 will not be increased, and damage on the front end of the sheet can be reduced and occurrence of jamming may be prevented.

The present embodiment adopts a configuration where the separating roller 54 is pushed down by the feed roller rubber 53*a*, but it is also possible to adopt a configuration where a tapered surface having a low friction coefficient is formed on an upstream side in the direction of rotation of the feed roller rubber 53*a*, and the tapered surface pushes down the separating roller 54. According to this configuration, the separating roller 54 and the separating roller holder 60 can be pushed down without fail before the sheet S reaches the separation nip N, and damaging of the front end of the sheet S can be prevented.

Further, the guide surface 63*c* is formed to be abutted approximately perpendicularly against the sheet bundle Sa stacked on the intermediate plate 56 in the state where the nip guide 63 is abutted against the stopper 65. In other words, the guide surface 63*c* is formed along a direction approximately to the sheet conveyance direction. Thus, it is possible to prevent the front end of the sheet bundle Sa from being damaged due to the guide surface 63*c* sliding against the sheet bundle Sa by the separating roller holder 60 being rotated and the nip guide 63 following the movement. The term approximately perpendicular or approximately orthogonal does not necessary refer to an angle of 90 degrees, and can be any angle between 80 and 100 degrees, for example.

Moreover, the front end guide 63*b* is formed to be approximately in parallel with the sheet bundle Sa stacked on the intermediate plate 56 in the state where the nip guide 63 is abutted against the stopper 65. In other words, the front end guide 63*b* is formed approximately in parallel with the sheet conveyance direction. Therefore, the reaction force of the nipping force acting on the front end guide 63*b* from the bundle of sheets S sandwiched between the front end guide 63*b* and the feed roller 53 acts in a balanced manner across the whole surface of the front end guide 63*b*. According to this configuration, the nip guide 63 can be rotated smoothly, and the surface of the sheet S can be prevented from being damaged by having force concentrate to a portion of the surface of the sheet S.

The term approximately parallel does not necessary refer to a state where the angle between the front end guide 63*b* and the sheet bundle Sa is 0 degrees, and for example, the sheet S can be guided smoothly to the separation nip N by slightly inclining the sheet to approach the separation nip N toward the downstream side in the sheet conveyance direction.

Figure 12A:
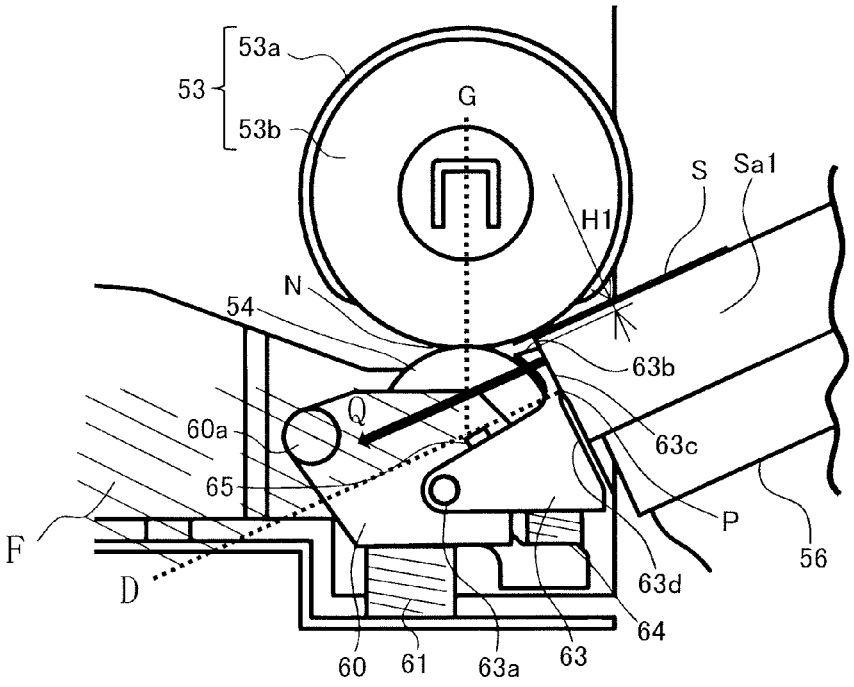
FIG. 12A is an explanatory view illustrating a position of a rotation fulcrum of a separating roller holder.
Figure 12B:
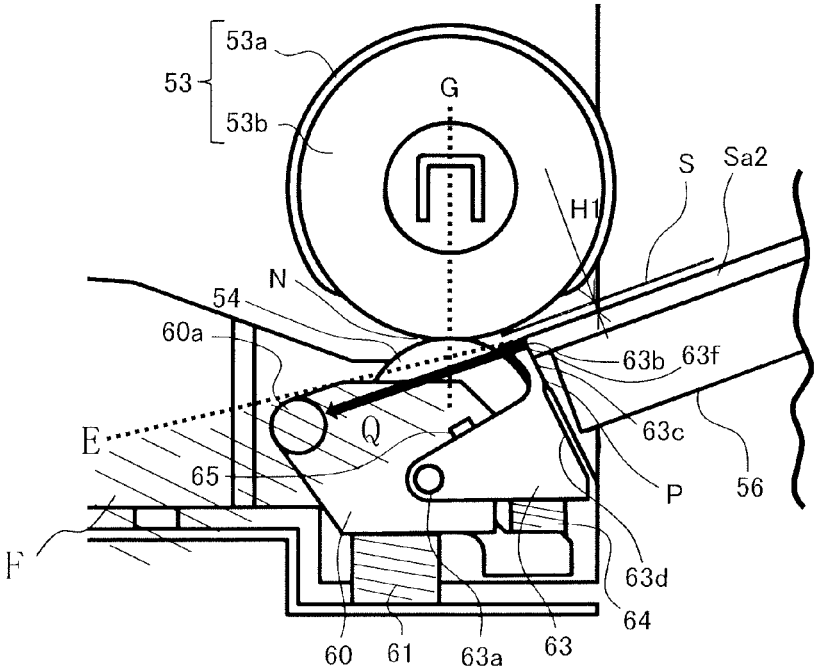
FIG. 12B is an explanatory view illustrating a position of the rotation fulcrum of the separating roller holder.

Next, the position of the rotation fulcrum 60*a* of the separating roller holder 60 will be described with reference to FIGS. 12A and 12B. As shown in FIG. 12A, the rotation fulcrum 60*a* passes an end portion P of a side farthest from the feed roller 53 of the guide surface 63*c*, and is positioned at a side close to the feed roller 53 with respect to a third straight line D in parallel with the surface of a sheet bundle Sa1 having an upper limit height capable of being stacked on the intermediate plate 56. Further, as shown in FIG. 12B, the rotation fulcrum 60*a* is arranged on a side far from the feed roller 53 with respect to a fourth straight line E. The fourth straight line E is a straight line that passes an end portion 63*f* of a side closest to the feed roller 53 of the guide surface 63*c*, and is parallel to the surface of a sheet bundle Sa2 stacked on the intermediate plate 56 having a thickness equal to or smaller than a given thickness in a state abutted against the feed roller 53. The sheet bundle Sa2 having a thickness equal to or smaller than the given thickness can be a sheet bundle composed of two or three sheets, for example.

Further, the rotation fulcrum 60*a* is arranged on a downstream side in the sheet conveyance direction than a normal line G of the separation nip N, that is, a line perpendicular to a tangent of the feed roller 53 and the separating roller 54 in the separation nip N. As described, the area on a side close to the feed roller 53 with respect to the third straight line D, on a side far from the feed roller 53 with respect to the fourth straight line E, and on a downstream side in the sheet conveyance direction than the normal line G (shaded area in the drawing) is referred to as area F.

In the present embodiment, the rotation fulcrum 60*a* of the separating roller holder 60 is positioned within area F, so that the pressing force in a direction of arrow Q acting on the guide surface 63*c* from the sheet bundle Sa1 or the sheet bundle Sa2 during feeding of the sheet acts roughly toward the rotation fulcrum 60*a*. Therefore, this pressing force acting on the separating roller holder 60 via the nip guide 63 restricted of movement by the stopper 65 does not act as a rotational moment of the separating roller holder 60. Thereby, even if the thickness of the sheet bundle Sa stacked on the intermediate plate 56 is varied, a contact pressure (separation pressure) of the separation nip N during sheet feed will not change, and the sheet S can be separated one by one in a stable manner.

As described, according to the present embodiment, when various types of sheets Shaving different stiffness enter the guide surface 63*c* of the nip guide 63, the nip guide 63 will not rotate regardless of whether the sheet S is a bundle or a single sheet, and the sheet can be guided to the separation nip N without the front end of the sheet being damaged.

When the bundle of sheets S is sandwiched between the front end guide 63*b* of the nip guide 63 and the feed roller 53, the nip guide 63 rotates in the direction moving away from the feed roller 53. At this time, the separating roller holder 60 will not rotate together with the nip guide 63, and the state is maintained where the separating roller 54 presses the feed roller 53. Thereby, overlapped feeding of the sheet S can be prevented, and occurrence of jamming can be prevented.

According to this configuration, the sheet S can reliably be separated one by one and conveyed to the image forming portion 30, in correspondence with the increase in speed, downsizing, and the diversification of the printer or other image forming apparatuses.

Embodiment 2

Figure 13:
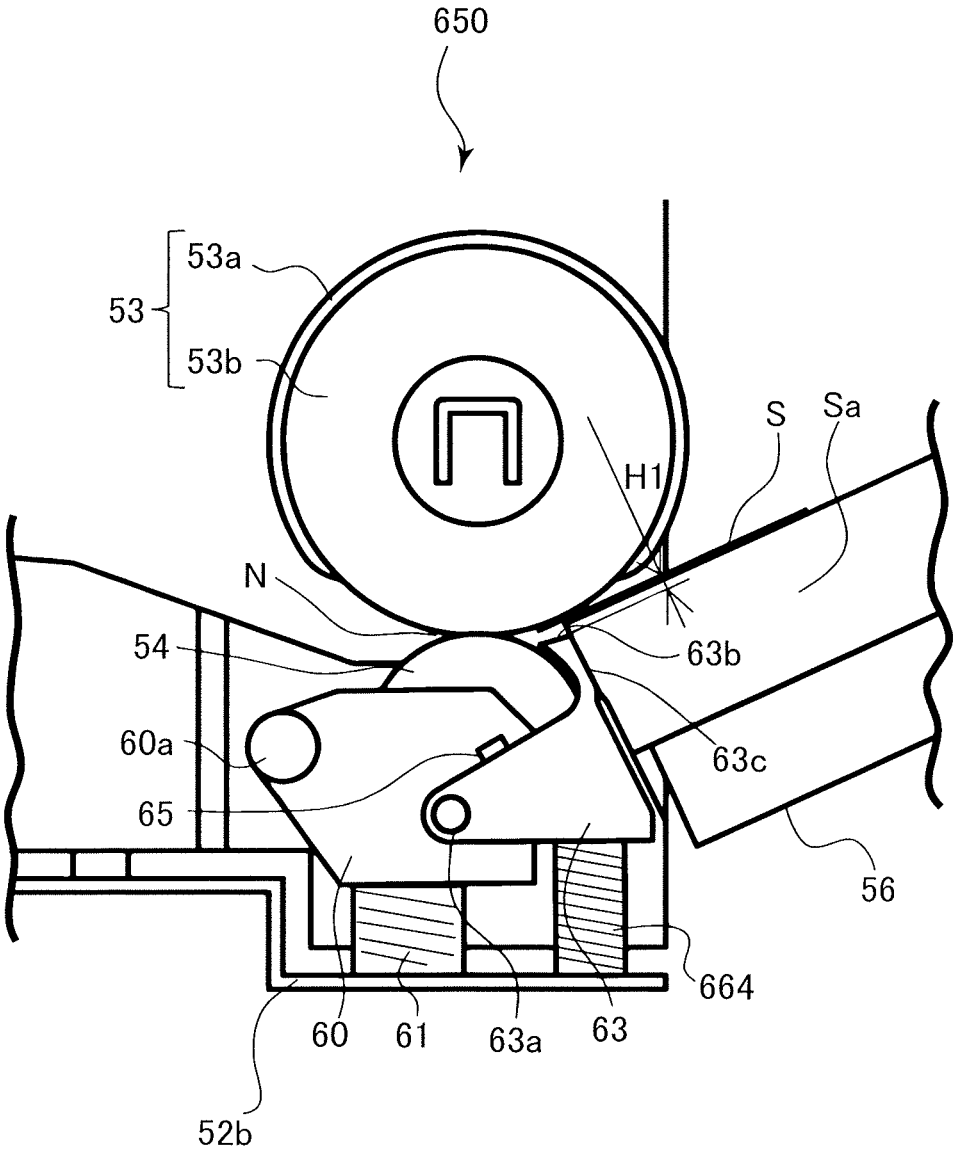
FIG. 13 is a front view showing a manual sheet feed portion according to Embodiment 2 of the present invention.

Next, Embodiment 2 of the present invention will be described, wherein components that are the same as Embodiment 1 described above are denoted with the same reference numbers in the drawings, and detailed descriptions thereof are omitted. As shown in FIG. 13, the nip guide 63 of a sheet feeding apparatus 650 is biased toward the feed roller 53 via a nip guide spring 664. The nip guide spring 664 is disposed in a compressed manner between the nip guide 63 and the bottom panel 52*b* of the sheet feed frame 52.

Therefore, when the nip guide 63 is rotated in the clockwise direction opposing to the biasing force of the nip guide spring 664, hardly any force acts on the separating roller holder 60. Therefore, the freedom of design of the nip guide spring 664 and the separation spring 61 can be improved.

Embodiment 3

Next, Embodiment 3 of the present invention will be described, wherein components that are the same as Embodiment 1 described above are denoted with the same reference numbers in the drawings, and detailed descriptions thereof are omitted. In Embodiment 3, a nip guide is composed of two members.

Figure 14:
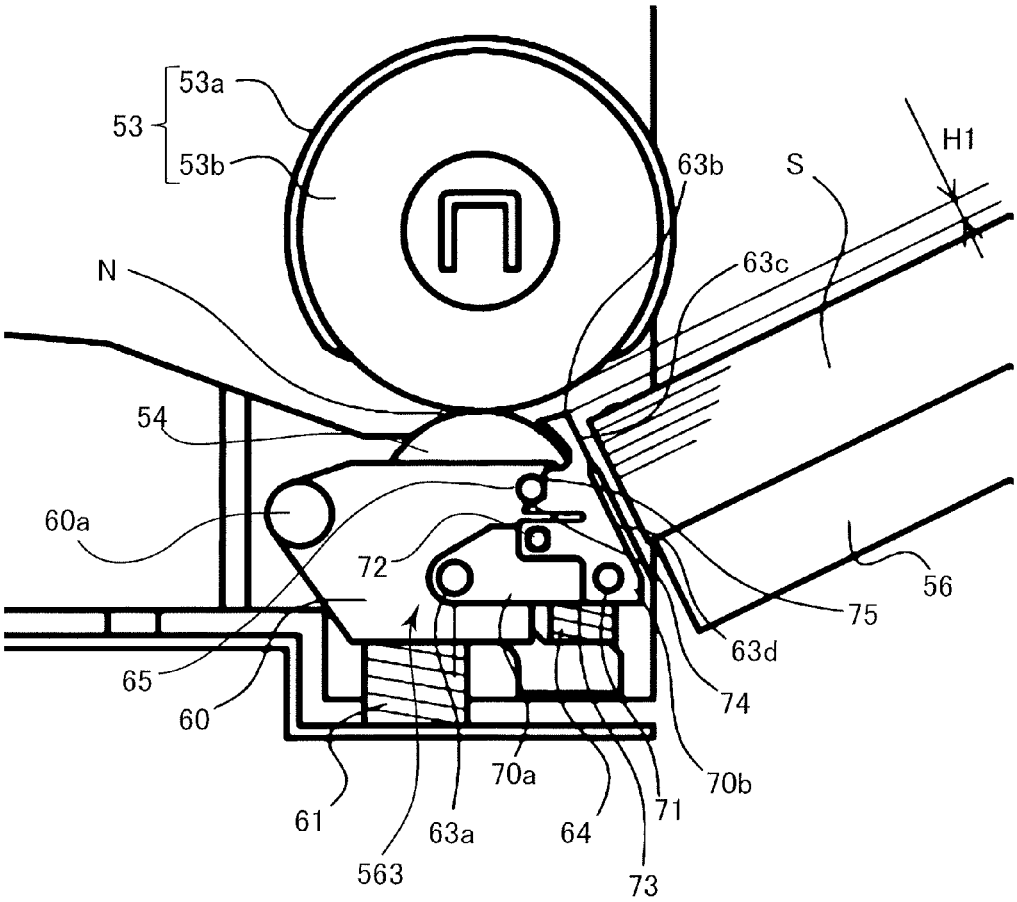
FIG. 14 is a front view showing a manual sheet feed portion according to Embodiment 3 of the present invention, showing a state where a guide member is at a mounted position mounted to a support member.

As shown in FIG. 14, a nip guide 563 is composed of a support member 70*a* (rotating member) rotatably supported on the separating roller holder 60 around the rotation fulcrum 63*a*, and a guide member 70*b* rotatably supported on the support member 70*a* around a rotation fulcrum 71. The guide member 70*b* has formed thereto a guide surface 63*c* to which a front end of the sheet S contacts, and a front end guide 63*b* capable of guiding the sheet S smoothly to the separation nip N.

The nip guide 563 is biased upward by the nip guide spring 64 (second biasing member), and positioned at an abutting position where it is abutted against the stopper 65 (regulating portion) disposed on the separating roller holder 60. The nip guide spring 64 is disposed in a compressed manner between the nip guide 563 and the separating roller holder 60. When the nip guide 563 is in the abutting position, the front end guide 63*b* and the outer peripheral surface of the feed roller 53 are separated by a given distance H1.

Figure 15A:
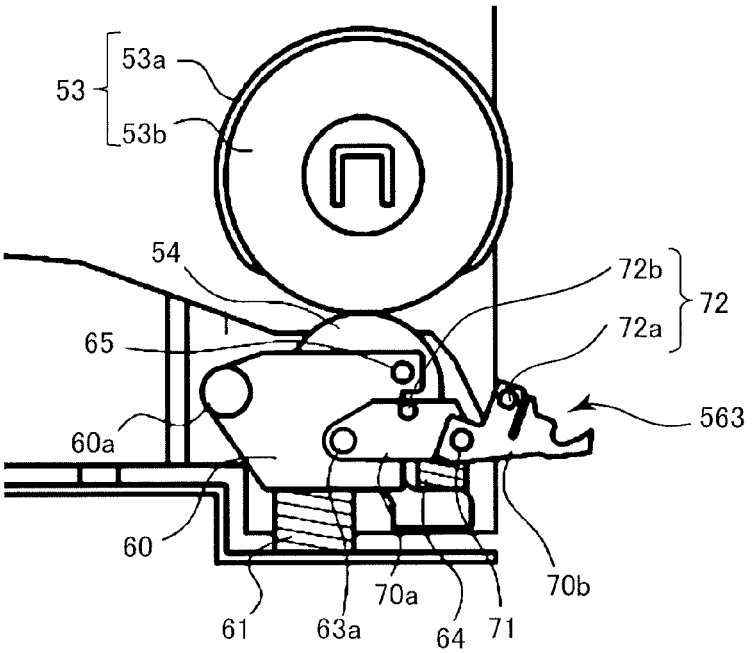
FIG. 15A is a front view showing a manual sheet feed portion in a state where the guide member is positioned at an opened position.
Figure 15B:
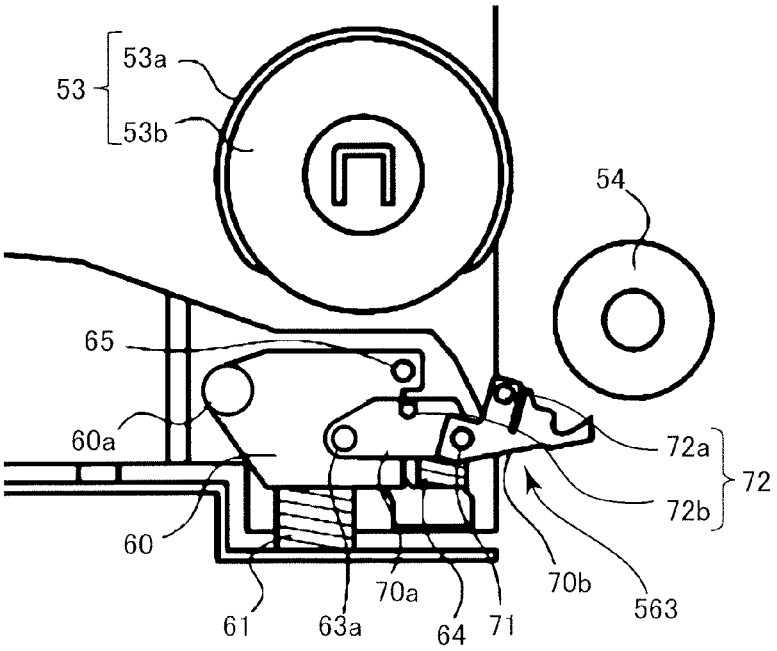
FIG. 15B is a front view showing a manual sheet feed portion in a state where the separating roller is removed.

As shown in FIGS. 14 through 15B, the guide member 70*b* can be moved between a mounted position mounted to the support member 70*a* and an opened position separated with respect to the support member from the mounted position.

An engaging claw 72*a* (second engaging portion) is provided on the guide member 70*b*, and an engaging groove 72*b* (first engaging portion) is provided on the support member 70*a*, wherein the engaging claw 72*a* and the engaging groove 72*b* constitute a snap-fit 72. By the engagement of the engaging claw 72*a* and the engaging groove 72*b*, the guide member 70*b* is positioned at the mounted position. When the guide member 70*b* is at the mounted position, the guide member 70*b* rotates integrally with the support member 70*a* around the rotation fulcrum 63*a*.

In the present embodiment, the engaging claw is disposed on the guide member 70*b* and the engaging groove is disposed on the support member 70*a*, but it is merely necessary to provide the engaging claw to either the guide member 70*b* or the support member 70*a*, and to provide the engaging groove to the other member. Further, the configuration and shape of the snap-fit 72 is not restricted.

The guide member 70*b* can be moved to the opened position as shown in FIG. 15B by releasing the lock of the snap-fit 72, and in the opened position, the clearance between guide member 70*b* and the feed roller 53 can be widened. While the guide member 70*b* is in the opened position, the separating roller 54 can be removed through the space formed between the guide member 70*b* and the feed roller 53. According to this configuration, an operator can easily replace the separating roller 54, and the maintenance property is improved.

In the mounted position, the guide member 70*b* is pressed onto the stopper 65 by the nip guide spring 64 disposed in a compressed manner between a spring seat surface 73 and the separating roller holder 60. By being abutted against the cylindrical stopper 65, the guide member 70*b* has a first regulating surface 74 regulating the movement around the rotation fulcrum 63*a* toward a direction approximating the feed roller 53, and a second regulating surface 75 regulating the movement toward the sheet conveyance direction.

Figure 16:
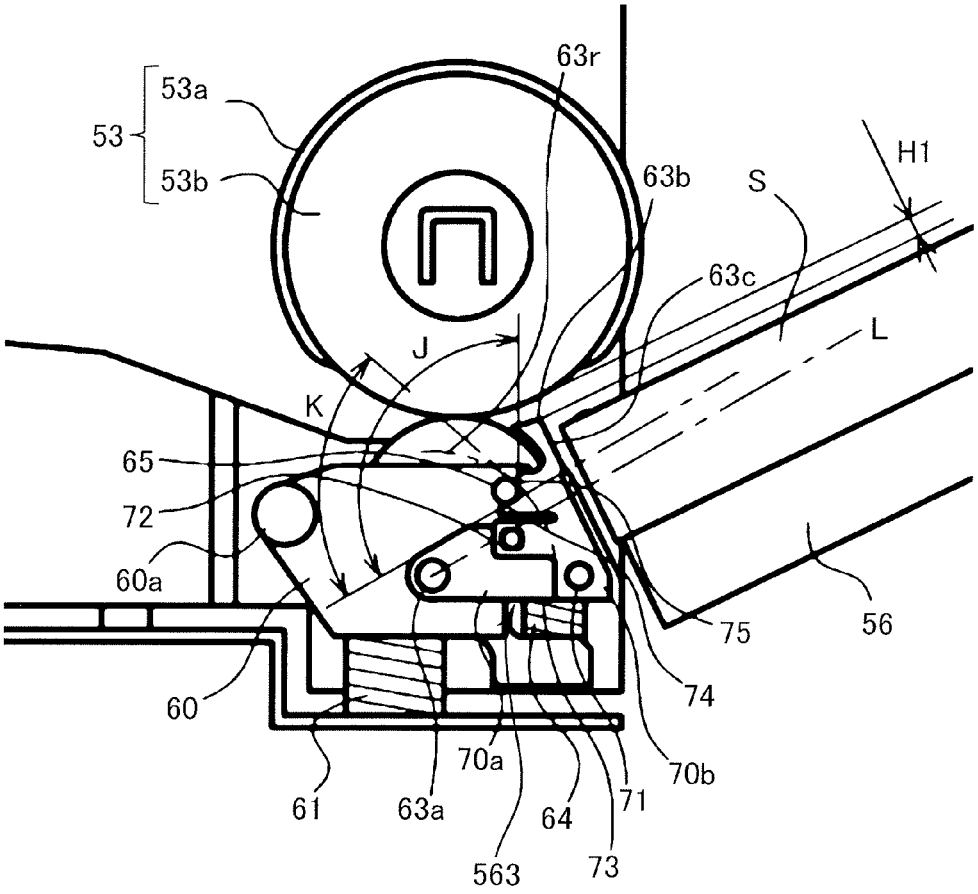
FIG. 16 is an explanatory view illustrating a first regulating surface and a second regulating surface of a guide member.

As shown in FIG. 16, the first regulating surface 74 is formed approximately in parallel with a normal line direction L of a swinging locus 63*r* of the guide member 70*b* around the rotation fulcrum 63*a*. The swinging locus 63*r* is a circle having its center at the rotation fulcrum 63*a* and in contact with an outer periphery of the stopper 65. The second regulating surface 75 is designed so that the angle formed with the first regulating surface 74 is angle J. Angle J is set to satisfy the following condition: tangent angle K<J<180 degrees. Tangent angle K is an angle formed by the tangent of the swinging locus 63*r* and the outer periphery of the stopper 65, and the first regulating surface 74. For example, if the angle J is set equal to the tangent angle K, due to the dispersion of accuracy of dimension of the guide member 70*b* and the support member 70*a*, when the guide member 70*b* rotates around the rotation fulcrum 71, the second regulating surface 75 and the stopper 65 may interfere with one another, preventing smooth rotation of the guide member. Therefore, according to the present embodiment, the second regulating surface 75 is formed along the vertical direction, and angle J is set to satisfy tangent angle K<J<180 degrees, so that the guide member 70*b* can rotate smoothly.

Figure 17A:
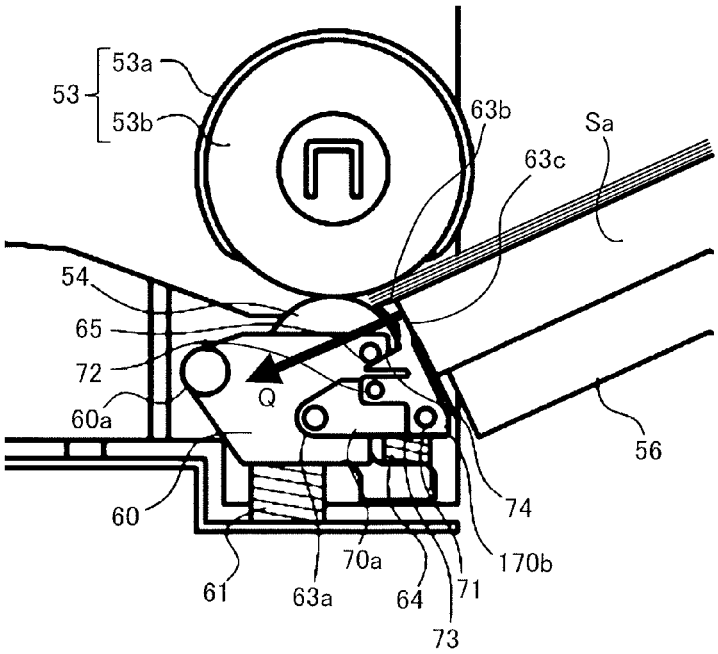
FIG. 17A shows a front view of a comparative example where only the first regulating surface is provided to the guide member.

Next, as a comparative example, a case where either one of the first regulating surface 74 or the second regulating surface 75 is provided to the guide member 70*b* will be described with reference to FIG. 17. FIG. 17A illustrates a case where only the first regulating surface 74 is provided to a guide member 170*b*. When the guide surface 63*c* of the guide member 170*b* receives a pressing force in a direction of arrow Q by the sheet bundle Sa, an upper end portion of the guide member 170*b* including the front end guide 63*b* moves to the direction of arrow Q. This is caused by the deformation of the guide member 170*b* or mounting backlash of the guide member 70*b* and the support member 70*a*.

When the amount of movement of the upper end of the guide member 170*b* is increased, the guide member 170*b* and the separating roller 54 may contact each other, preventing the rotation of the separating roller 54. When the front end of the sheet contacts the separating roller 54 in the state where the separating roller 54 is stopped, the front end of the sheet cannot enter the separation nip N since the friction coefficient of the peripheral surface of the separating roller 54 is too high, and jamming or damaging of the front end of the sheet occurs.

Figure 17B:
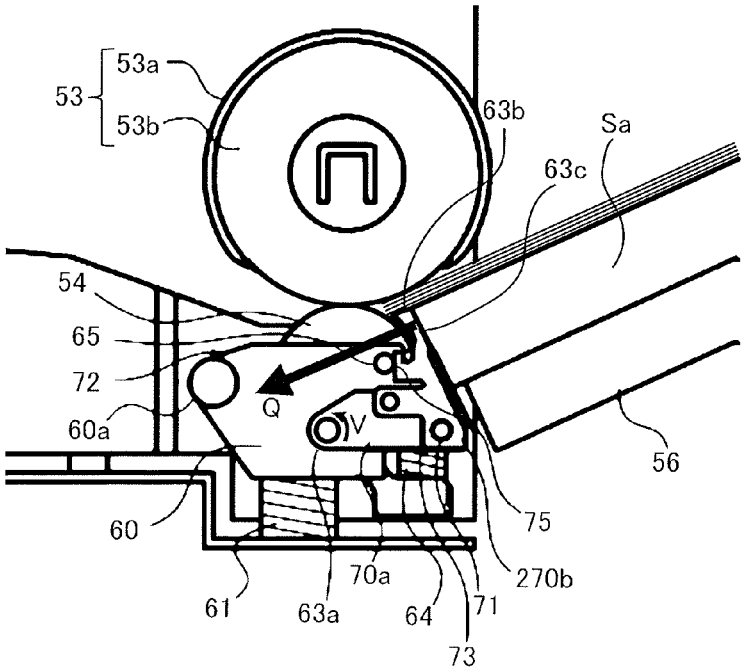
FIG. 17B is a front view of a comparative example where only the second regulating surface is provided to the guide member.
Figure 18:
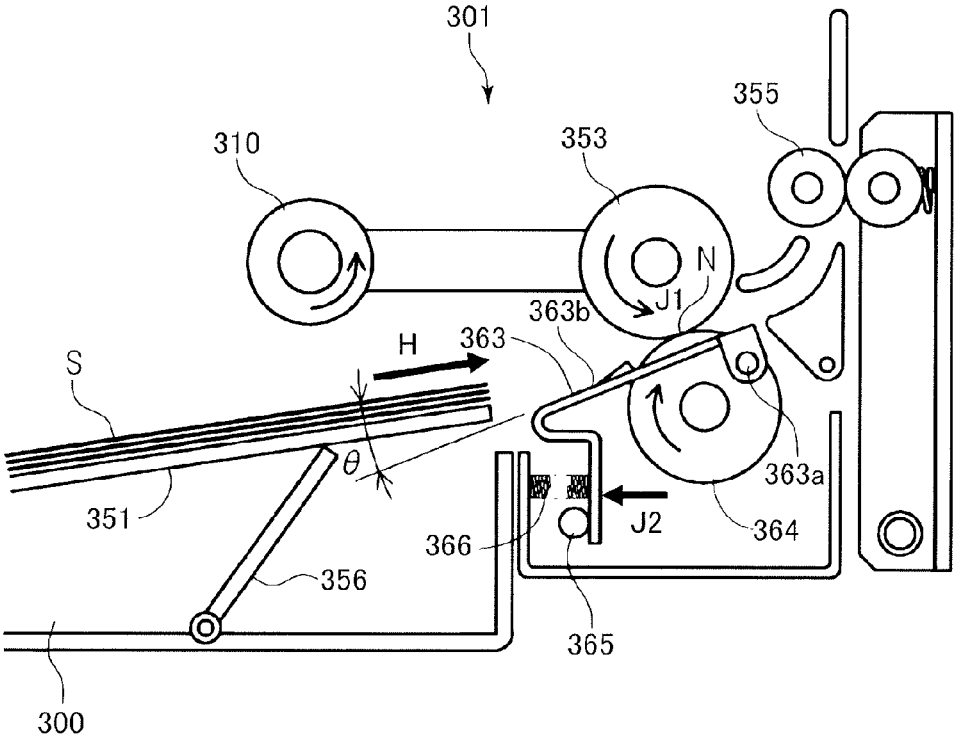
FIG.18 (Prior Art)
FIG. 18 is an overall schematic diagram showing a sheet feeding apparatus according to a prior art.
Figure 19A:
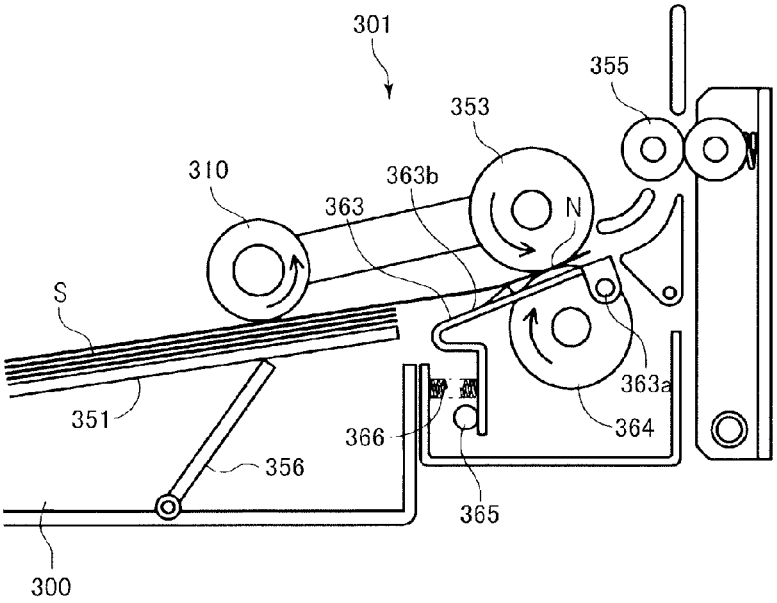
FIG.19A (Prior Art)
FIG. 19A is a view of the prior art sheet feeding apparatus, showing a state where a single sheet is fed.
Figure 19B:
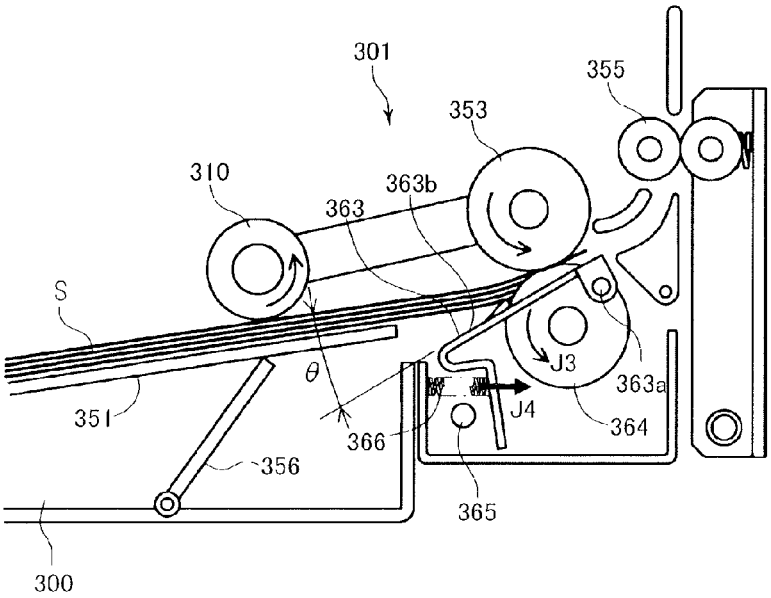
FIG.19B (Prior Art)
FIG. 19B is a view of the prior art sheet feeding apparatus, showing a state where a plurality of sheets are fed.

FIG. 17B illustrates a case where only the second regulating surface 75 is provided to a guide member 270*b*. When the guide surface 63*c* of the guide member 270*b* receives a pressing force in the direction of arrow Q by the sheet bundle Sa, a rotating force in a direction of arrow V around the rotation fulcrum 63*a* is generated to the guide member 270*b* and the support member 70*a*. By this rotating force, the front end guide 63*b* moves in a direction approximating the feed roller 53. When the amount of this movement is increased and the front end guide 63*b* contacts the feed roller 53, the guide member 270*b* will block the separation nip N, and the sheet S cannot be fed to the separation nip N. In another example, a conveying force may occur between the front end guide 63*b* and the feed roller 53, causing multiple sheets S to surpass the separation nip N, leading to overlapped feeding or jamming of sheets.

In consideration of the above-described problems of the comparative example, in the present embodiment, as shown in FIG. 16, the guide member 70*b* is constituted to be abutted against the stopper 65 on two surfaces, the first regulating surface 74 and the second regulating surface 75. Thereby, it becomes possible to maintain a stable sheet feeding performance without being greatly influenced by the dimension accuracy or mounting backlash of the guide member 70*b* and the support member 70*a*, or the pressing force that the guide member 70*b* receives from the sheet bundle Sa during conveyance of the sheet.

As described, the present invention enables to provide a sheet conveyance apparatus capable of infallibly separating the sheets S one by one without damaging the sheets S and having superior exchangeability of the separating roller, capable of corresponding to the increase in speed and downsizing of printers and other image forming apparatuses, and the diversification of the media being used.

According to a preferred embodiment, a configuration can be adopted where the guide member 70*b* is detachably mounted to the support member 70*a*.

According to the three preferred embodiments illustrated above, the stopper 65 can be composed integrally with the separating roller holder 60, or an independent member can be fixed to the separating roller holder 60. Moreover, the stopper 65 can be fixed to a member other than the separating roller holder 60.

According to the three embodiments described above, the manual sheet feed portion 50 equipped with the feed roller 53 and the separating roller 54 has been illustrated as an example, but similar effects can be achieved by adopting the following sheet feed system. For example, it is possible to use a pickup roller to feed sheets, and have a feed roller and a separating roller separate the sheets one by one. For example, it is possible to use a retard roller (separating roller) that rotates in a direction opposite to the sheet feed direction instead of the separating roller, or to separate the sheets one by one using a non-rotating member such as a separating pad (separating member).

Furthermore, the present invention can be applied not only to manual sheet feeding portions, but also to cassette-type cassette sheet feeding portions. Further, the present invention can be applied to sheet feeding apparatuses having a sheet stacked directly on a sheet tray without a liftable intermediate plate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-246302, filed Dec. 4, 2014, and Japanese Patent Application No. 2014-246301, filed Dec. 4, 2014, which are hereby incorporated by reference herein in its entirety.

What is claimed is:

1. A sheet conveyance apparatus comprising:

a stacking portion on which sheets are stacked;

a rotator conveying a sheet by rotating in a contact state with the sheet stacked on the stacking portion;

a separating member pressing the rotator and separating the sheets one by one at a contact portion where the rotator and the separating member contact each other;

a holder holding the separating member;

a guide portion rotatably provided with the holder and capable of guiding a front end of the sheet to the contact portion, the guide portion configured to rotate with respect to the holder in a direction separating from the rotator in a state where the separating member presses the rotator;

a regulating portion regulating the guide portion from rotating in a direction approaching the rotator in a state where the guide portion contacts against the regulating portion, and a guide portion biasing member biasing the guide portion, at a position upstream of the contact portion in a sheet conveyance direction, toward the rotator, wherein the guide portion covers both the holder and the separating member from outside in a width direction orthogonal to the sheet conveyance direction, and is arranged upstream of a downstream end, in the sheet conveyance direction, of the separating member.

2. The sheet conveyance apparatus according to claim 1, wherein the guide portion comprises an abutting surface against which the sheets stacked on the stacking portion abuts, and the guide portion is pressed against the regulating portion by having a force along the sheet conveyance direction act on the abutting surface.

3. The sheet conveyance apparatus according to claim 1, wherein the guide portion comprises a pressure surface against which a sheet bundle conveyed between the rotator and the guide portion abuts, and the guide portion rotates in a direction separating from the rotator in a case where the pressure surface is pressed by the sheet bundle.

4. The sheet conveyance apparatus according to claim 2, wherein a rotation fulcrum of the guide portion is positioned on a side far from the rotator with respect to a straight line passing an end portion, closest to the rotator, of the abutting surface and perpendicular to the abutting surface, and on a side close to the contact portion with respect to a straight line passing a downstream end, in the sheet conveyance direction, of the pressure surface and in parallel with a normal line of the contact portion.

5. The sheet conveyance apparatus according to claim 1, wherein the regulating portion is disposed on the holder.

6. The sheet conveyance apparatus according to claim 2, wherein the abutting surface is formed along a direction approximately orthogonal to the sheet conveyance direction in a state where the guide portion is abutted against the regulating portion.

7. The sheet conveyance apparatus according to claim 3, wherein the pressure surface is formed approximately in parallel with the sheet conveyance direction in a state where the guide portion is abutted against the regulating portion.

8. The sheet conveyance apparatus according to claim 1, further comprising:

a frame member configured to rotatably support the holder; and a holder biasing member biasing the holder so as to press the separating member to the rotator wherein the separating member is maintained so as to press the rotator by the guide portion biasing member in a case where the guide portion rotates in a direction separating from the rotator against a biasing force of the guide portion biasing member.

9. The sheet conveyance apparatus according to claim 8, wherein the guide portion biasing member is disposed in a compressed manner between the holder and the guide portion, and a biasing force of the holder biasing member is greater than a biasing force of the guide portion biasing member.

10. The sheet conveyance apparatus according to claim 8, wherein the guide portion biasing member is disposed in a compressed manner between the guide portion and the frame member.

11. The sheet conveyance apparatus according to claim 2, wherein the guide portion comprises a rotating member rotatably provided with the holder, and a guide member, having the abutting surface, independently and rotatably provided with the rotating member.

12. The sheet conveyance apparatus according to claim 11, wherein the guide member is mounted to the rotating member and capable of being moved between a mounted position covering the rotating member and an opened position separating the rotating member from the mounted position, and rotates integrally with the rotating member around a rotation fulcrum of the rotating member at the mounted position.

13. The sheet conveyance apparatus according to claim 12, wherein the separating member is removable from a space between the rotator and the guide member in a state where the guide member is positioned at the opened position.

14. The sheet conveyance apparatus according to claim 12, wherein the rotating member comprises a first engaging portion, and the guide member comprises a second engaging portion being engaged with the first engaging portion at the mounted position.

15. The sheet conveyance apparatus according to claim 12, wherein the guide member comprises a first regulating surface abutting against the regulating portion and regulating movement of the guide portion toward a direction approaching the rotator, and a second regulating surface abutting against the regulating portion and regulating movement of the guide portion toward the sheet conveyance direction.

16. The sheet conveyance apparatus according to claim 15, wherein the regulating portion is formed in a cylindrical shape, the first regulating surface is formed in parallel with a normal line of a circle, centered around the rotation fulcrum of the rotating member, in contact with an outer periphery of the regulating portion, and the second regulating surface is formed such that an angle between the first regulating surface and the second regulating surface is greater than an angle formed by a tangent at a contact point between the circle and the regulating portion and the first regulating surface, and smaller than 180 degrees.

17. The sheet conveyance apparatus according to claim 12, further comprising:

a holder biasing member biasing the holder to press the separating member to the rotator, wherein the guide member biasing member biases the guide member positioned at the mounted position to a direction approaching the rotator.

18. An image forming apparatus comprising:

a sheet conveyance apparatus according to claim 1; and an image forming portion forming an image on a sheet conveyed from the sheet conveyance apparatus.

19. The sheet conveyance apparatus according to claim 1, wherein the guide member biasing member is arranged upstream of the contact portion in the sheet conveyance direction.

20. The sheet conveyance apparatus according to claim 19, wherein the guide member biasing member is arranged below the guide portion and biases the guide portion upward to the rotator.

* * * * *